US011339016B2

(12) United States Patent
Sugita

(10) Patent No.: US 11,339,016 B2
(45) Date of Patent: May 24, 2022

(54) SHEET FEEDING DEVICE AND IMAGE FORMING APPARATUS INCORPORATING THE SHEET FEEDING DEVICE

(71) Applicant: Junichi Sugita, Tokyo (JP)

(72) Inventor: Junichi Sugita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 178 days.

(21) Appl. No.: 16/752,842

(22) Filed: Jan. 27, 2020

(65) Prior Publication Data

US 2020/0239248 A1 Jul. 30, 2020

(30) Foreign Application Priority Data

Jan. 30, 2019 (JP) ..... JP2019-013953
Apr. 4, 2019 (JP) ..... JP2019-072029

(51) Int. Cl.
*B65H 3/06* (2006.01)
*B65H 3/34* (2006.01)

(52) U.S. Cl.
CPC ..... *B65H 3/0684* (2013.01); *B65H 3/34* (2013.01)

(58) Field of Classification Search
CPC ..... B65H 1/04; B65H 3/06; B65H 3/0684; B65H 3/34; B65H 9/004; B65H 9/06; B65H 2402/64; B65H 2404/72; B65H 2404/722; B65H 2404/725
See application file for complete search history.

(56) References Cited

U.S. PATENT DOCUMENTS

2002/0033572 A1* 3/2002 Takisawa ..... B65H 3/5261 271/109
2007/0158898 A1* 7/2007 Hung ..... B65H 3/34 271/109
2010/0133741 A1 6/2010 Satoh
2016/0334748 A1 11/2016 Aoyama et al.
2019/0283990 A1 9/2019 Zaitsu et al.

FOREIGN PATENT DOCUMENTS

JP 2010-132383 8/2010

* cited by examiner

*Primary Examiner* — Prasad V Gokhale
(74) *Attorney, Agent, or Firm* — Harness, Dickey & Pierce, P.L.C.

(57) ABSTRACT

A sheet feeding device includes a contact member and a lock member. The contact member is configured to rotate from a retracted position to a contact position while a sliding portion of the lock member is sliding on a sliding target portion of the contact member and to rotate to the contact position to release the sliding portion of the lock member from the sliding target portion of the contact member. The lock member is configured to rotate between a locked position and a lock released position by a lock biasing force when the lock member moves in a lock direction of the lock member from the lock released position toward the locked position. The contact member has the lock target body and the sliding target portion at different positions from each other in a rotation center axial direction of the contact member.

12 Claims, 19 Drawing Sheets

SHEET FEEDING DEVICE AND IMAGE FORMING APPARATUS INCORPORATING THE SHEET FEEDING DEVICE

CROSS-REFERENCE TO RELATED APPLICATIONS

This patent application is based on and claims priority pursuant to 35 U.S.C. § 119(a) to Japanese Patent Application Nos. 2019-013953, filed on Jan. 30, 2019, and 2019-072029, filed on Apr. 4, 2019, in the Japan Patent Office, the entire disclosure of each of which is hereby incorporated by reference herein.

BACKGROUND

Technical Field

This disclosure relates to a sheet feeding device and an image forming apparatus incorporating the sheet feeding device.

Discussion of the Background Art

Various types of sheet feeding devices are known to include a contact unit to which the leading end in the sheet conveyance direction of a sheet contacts. The contact unit includes a contact member and a lock unit. The contact member of the contact unit is rotatable between a contact position at which the contact unit contacts the sheet and a retracted position at which the contact unit is spaced apart from the sheet. The lock unit of the contact unit locks a lock target portion of the contact member so as to restrict rotation of the contact member from the contact position to the retracted position. The lock unit includes a lock member that is rotatable between a locking position at which the lock unit locks the lock target portion and a locking release position at which the lock unit releases the locking state. In a sheet feeding devices, the lock member is applied with a lock biasing force by which the lock member moves in a locking direction from the locking release position to the locking position due to the own weight of the lock member or by a biasing member. In the sheet feeding device, the contact member rotates from the retracted position to the contact position while a sliding portion of the lock member slides on a sliding target portion of the contact member. When the contact member rotates and reaches the contact position, the sliding portion of the lock member comes off from the sliding target portion of the contact member. Consequently, the lock member rotates to the locking position due to the lock biasing force.

SUMMARY

At least one aspect of this disclosure provides a sheet feeding device including a contact member and a lock member. The contact member includes a contact body configured to contact a leading end of a sheet in a sheet conveyance direction, and lock target body. The contact member is configured to rotate between a contact position at which the contact body contacts the sheet and a retracted position at which the contact body is spaced away from the sheet. The lock member includes a lock body configured to lock the lock target body of the contact member to restrict rotation of the contact member from the contact position to the retracted position. The lock member is configured to rotate between a locked position at which the lock body locks the lock target body and a lock released position at which the lock body releases the lock target body. The lock member is configured to receive a lock biasing force applied due to a weight of the lock member or by a biasing member when the lock member moves in a lock direction of the lock member from the lock released position toward the locked position. The contact member is configured to rotate from the retracted position to the contact position while a sliding portion of the lock member and a sliding target portion of the contact member are sliding. The contact member is configured to rotate to the contact position to release the sliding portion of the lock member from the sliding target portion of the contact member. The lock member is configured to rotate to the locked position by the lock biasing force. The contact member has the lock target body and the sliding target portion at different positions from each other in a rotation center axial direction of the contact member.

Further, at least one aspect of this disclosure provides an image forming apparatus including the above-described sheet feeding device and an image forming device. The sheet feeding device is configured to feed a sheet. The image forming device is configured to form an image on the sheet fed from the sheet feeding device.

BRIEF DESCRIPTION OF THE SEVERAL VIEWS OF THE DRAWINGS

An exemplary embodiment of this disclosure will be described in detail based on the following figured, wherein.

Figure 1:
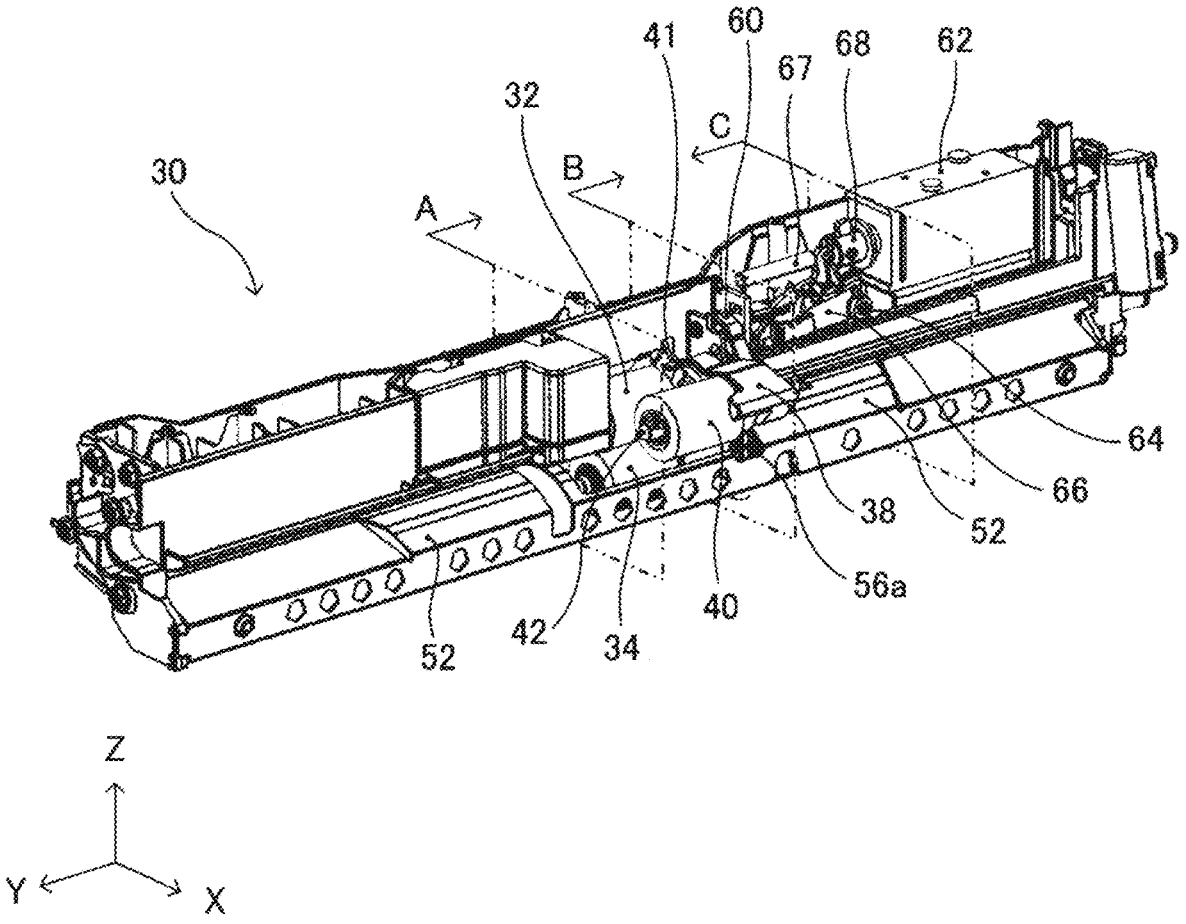
FIG. 1 is a perspective view illustrating a main part of a sheet feeding device according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet feeding device and an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet feeding device and image forming apparatus and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an electrophotographic image forming apparatus (hereinafter simply referred to as an image forming apparatus) which forms an image by an electrophotographic system is described as an image forming apparatus including a sheet feeding device according to this disclosure. In the following embodiments, a color laser printer is described as an example of the image forming apparatus. However, the image forming apparatus is not limited to a color printer but may be a monochrome printer. The image forming apparatus is not limited to the printer and may be another image forming apparatus such as a copier and a multifunction peripheral. The image forming apparatus including the sheet feeding device according to the present embodiment is not limited to the image forming apparatus of the electrophotographic system and may be an image forming apparatus of another system such as an ink jet system.

Now, a description is given of an electrophotographic image forming apparatus 100 for forming images by electrophotography, according to an embodiment of this disclosure. It is to be noted that, hereinafter, the electrophotographic image forming apparatus 100 is referred to as the image forming apparatus 100.

Figure 2:
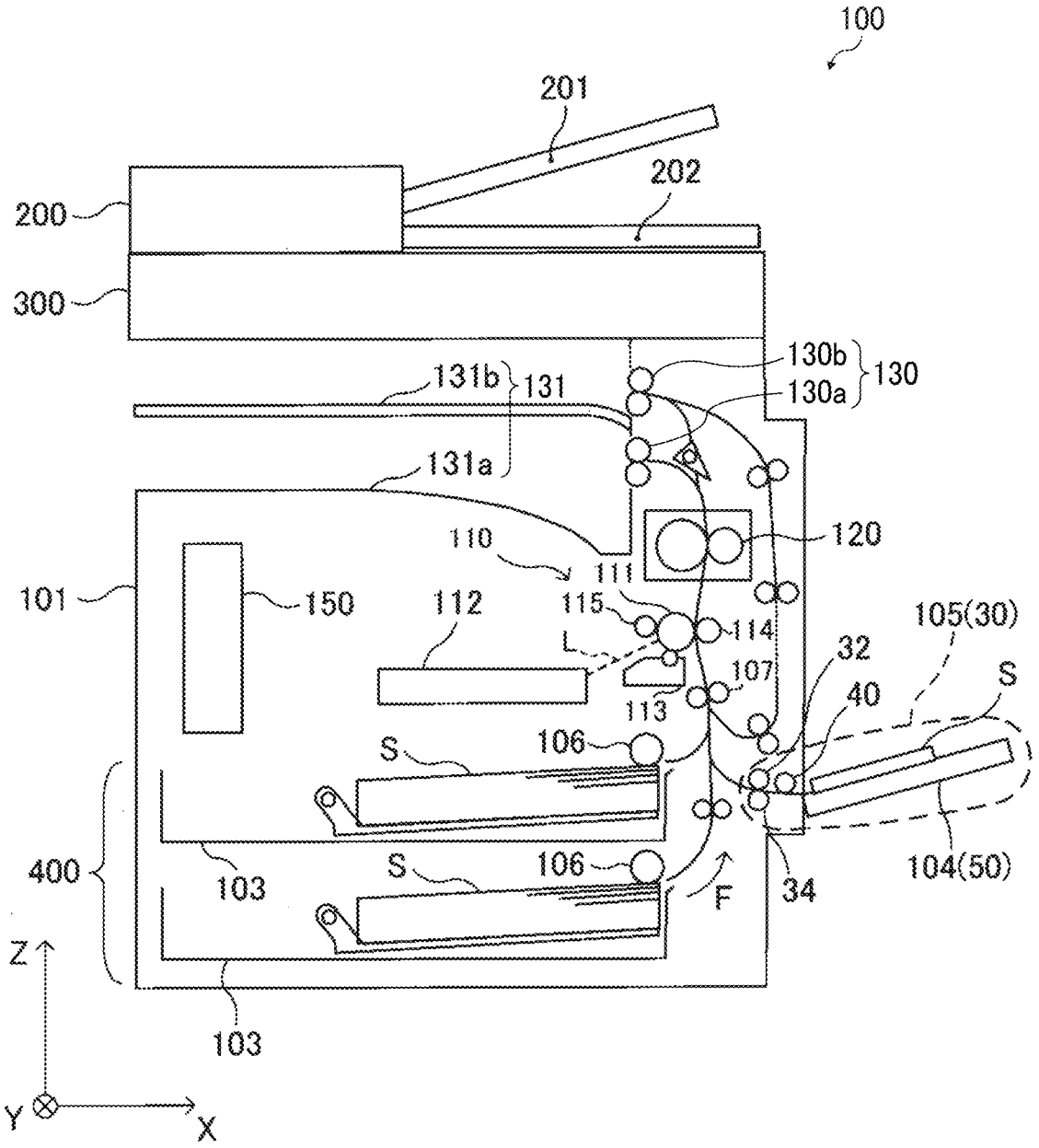
FIG. 2 is a schematic view illustrating an image forming apparatus according to an embodiment of this disclosure.

FIG. 2 is a schematic view illustrating an image forming apparatus 100 according to an embodiment of this disclosure.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

It is to be noted that reference sign "X" indicates is a direction from the front side to the rear side of the image forming apparatus 100, reference sign "Y" indicates is a direction from the left side to the right side of the image forming apparatus 100, and reference sign "Z" indicates is a direction perpendicular to the direction X and the direction Y.

The image forming apparatus 100 illustrated in FIG. 2 includes an automatic document feeder (ADF) 200 that functions as an automatic document feeder, a scanner 300 that functions as an image reading device, and a printing device 101 that functions as an image forming device to form an image on a sheet S having a sheet-like shape. The scanner 300 reads an image on a sheet-like original document conveyed by the ADF 200 and an image on the sheet-like original document placed on an exposure glass of the scanner 300. The printing device 101 forms an image on the sheet S based on image data input from an external device such as a personal computer or image data of the original document read by the scanner 300.

An image forming unit 110 that functions as a printer engine, a fixing unit 120, and an optical writing unit 112 are arranged in the printing device 101. Further, the printing device 101 includes an in-house sheet feeing unit 400 that includes in-house sheet feed trays 103, each of which stacks and stores the sheets S. Each of the in-house sheet feed trays 103 includes a sheet feed roller 106. Further, a bypass sheet feeding device 105 is disposed on the right side of the printing device 101 in FIG. 2. The bypass sheet feeding device 105 includes a bypass sheet feed tray 104 that functions as a sheet loader to load a sheet S for bypass operation. The bypass sheet feed tray 104 has functions corresponds to functions of a sheet feed tray 50 provided in a sheet feeding device 30 (see FIG. 1).

An operation panel (that is, an operation display unit 3) is disposed on top of the image forming apparatus 100. The operation panel (i.e., the operation display unit 3) is an input device to input print data.

Figure 3:
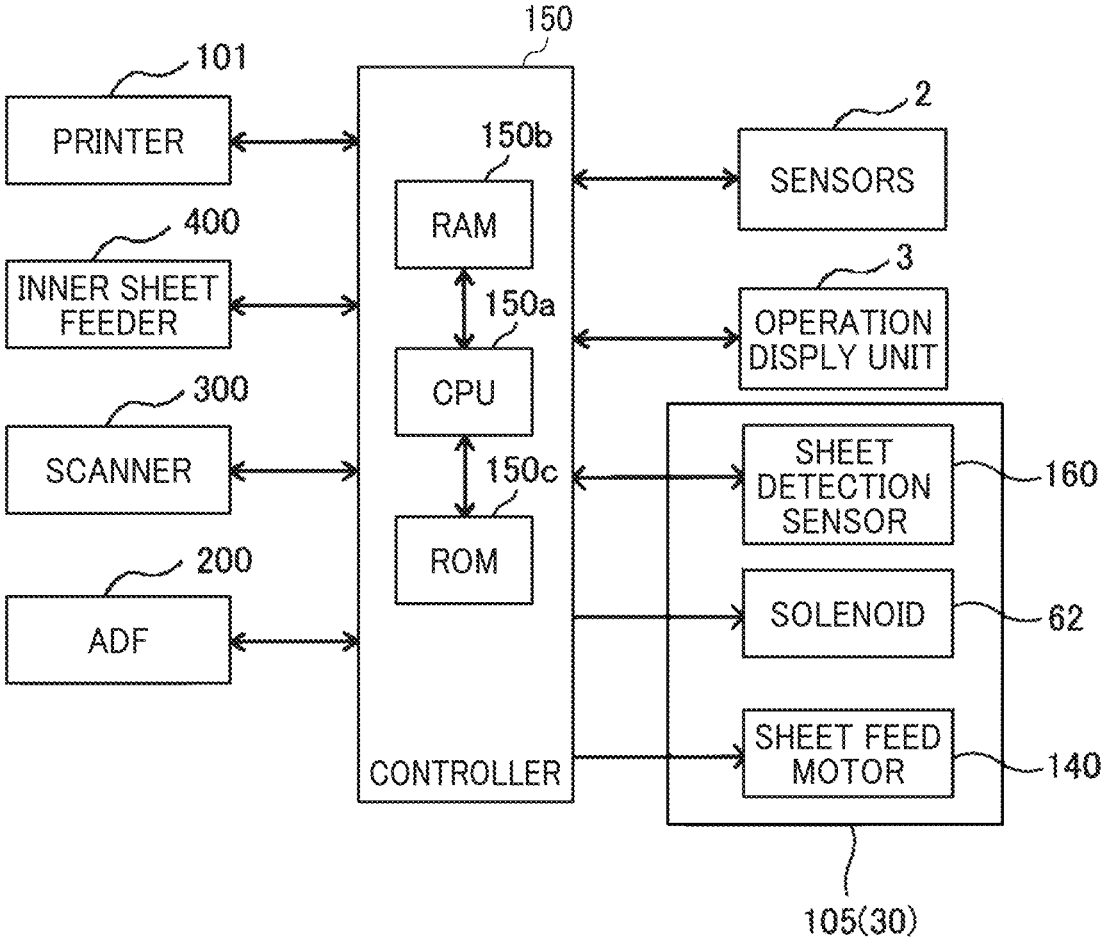
FIG. 3 is a block diagram illustrating the main part of the image forming apparatus according to an embodiment of this disclosure.

The printing device 101 further includes a controller 150 that controls units and devices in the image forming apparatus 100, based on input data that is input from an external device such as a personal computer or via the operation panel or detection data detected by sensors 2 (see FIG. 3).

FIG. 3 is a block diagram illustrating a main part of the image forming apparatus 100 according to an embodiment of this disclosure.

The image forming apparatus 100 includes the controller 150 that functions as a controller to control the whole system of the image forming apparatus 100. The controller 150 includes a CPU (Central Processing Unit) 150*a* and an information storing unit. The CPU 150*a* functions as an operating unit. The information storing unit includes a RAM (Random Access Memory) 150*b*, a ROM (Read-Only Memory) 150*c*, and an HDD (Hard Disk Drive), for storing data. In the present embodiment, for example, a system OS, a copy, a facsimile machine, various control programs for the printer process, a printer PDL (Page Description Language) processing system, a ROM 150*c* that stores initial setting values of the system, and the RAM 150*b* for working memory. The operation display unit 3 includes, e.g., a display portion and an operation portion. The display portion includes a liquid crystal display that displays, e.g., text information. The operation portion that functions as an operation receiver to receive input data input by an operator through a ten key and sends the input data to the controller 150.

A space is provided between the scanner 300 and the printing device 101. Two stackers 131 (i.e., a stacker 131*a* and a stacker 131*b*) are disposed above the printing device 101 provided in this space. The sheet S with the image formed by the printing device 101 is ejected and stacked in the stackers 131 (to be more specific, the stacker 131*a* and the stacker 131*b*). Further, a sheet conveyance passage is provided extending from either the in-house sheet feed trays 103 or the bypass sheet feed tray 104, to convey the sheet S through the image forming unit 110 toward the fixing unit 120. The sheet S is conveyed in a sheet conveyance direction indicated by arrow F in FIG.

The image forming unit 110 includes a drum-shaped photoconductor 111 that functions as an image bearer. A photoconductive layer is formed on a surface of the photoconductor 111. The photoconductor 111 is rotatably supported by a side plate of the printing device 101 and is driven by a drive source to rotate in a counterclockwise direction in FIG. 2. A charging roller 115, an irradiation and exposure position of optical light L, a developing unit 113, a transfer roller 114, and a cleaning member are disposed sequentially in this order around the photoconductor 111. The charging roller 115 functions as a charger. The irradiation and exposure position is a position to which the optical writing unit 112 emits the optical light L. The transfer roller 114 functions as a transfer body.

The surface of the charging roller 115 is in contact with the surface of the photoconductor 111. As the photoconductor 111 rotates and a charging bias is applied to the charging roller 115, a uniform electric charge is applied to the surface of the photoconductor 111. By so doing, the surface of the photoconductor 111 is uniformly charged to a constant potential.

The optical writing unit 112 emits a writing laser beam L that is the optical light L from the laser diode based on image data of the original document read by the scanner 300 or image data input from the external device, so as to irradiate and scan the surface of the photoconductor 111. By optically scanning the uniformly charged photoconductor 111, an electrostatic latent image is formed on the surface of the photoconductor 111.

The developing unit 113 includes a developer carrying member, a developer concentration detecting unit, and a pair of conveyance screws. The developer carrying member is disposed facing the surface of the photoconductor 111 to supply toner, which is developer, to the electrostatic latent image formed on the surface of the photoconductor 111. The pair of conveyance screws functions as a developer conveyance unit. The developing unit 113 having the above-described configuration develops the electrostatic latent image on the surface of the photoconductor 111 into a toner image.

The surface of the rotatable transfer roller 114 contacts the surface of the photoconductor 111 to form a transfer nip region. With this configuration, a transfer bias is applied from a transfer bias source to the transfer roller 114. With application of the transfer bias, the transfer roller 114 transfers the toner image formed on the surface of the photoconductor 111 onto the sheet S that is conveyed to the transfer nip region.

A pair of registration rollers 107 is disposed upstream from the transfer nip region in the sheet conveyance direction. The pair of registration rollers 107 controls transfer timing of the sheet S to the transfer nip region.

The sheet S is fed from one of the in-house sheet feed trays 103 and is conveyed to the transfer nip region by the pair of registration rollers 107. When the sheet S passes the transfer nip region, the toner image formed on the surface of the photoconductor 111 is transferred onto the sheet S. The sheet S having the toner image is conveyed to the fixing unit 120 where the toner image is fused by application of heat and pressure so that the toner image is fixed to the sheet S. After the toner image is fixed to the sheet 5, the sheet S is sequentially ejected and stacked as an output image (a copy) by pairs of sheet ejection rollers 130 (to be more specific, a pair of sheet ejection roller 130*a* or a pair of sheet ejection roller 130*b*) to the stackers 131 (to be more specific, the stacker 131*a* or the stacker 131*b*).

As the sheet S that functions as a sheet is loaded on the bypass sheet feed tray 104 of the bypass sheet feeding device 105, the sheet S is fed by a bypass pickup roller (i.e., a sheet pickup roller 40), which functions as a sheet feeding member, toward a downstream side in the sheet conveyance direction. When two or more sheets S are fed, a sheet feed roller 32 and a sheet separation roller 34, which compose a bypass separation mechanism that functions as a separation sheet feeder, separate the two or more sheets S to a single sheet S. Then, the separated single sheet S is fed into the sheet conveyance passage, toward the pair of registration rollers 107.

The bypass separation mechanism of the present embodiment forms a separation nip region by the pair of rollers, that is, the sheet feed roller 32 and the sheet separation roller 34. When a plurality of sheets S enters the separation nip region, the bypass separation mechanism conveys an uppermost sheet S alone to the downstream side in the sheet conveyance direction and applies a sheet conveyance force that brings the rest of sheets S toward an upstream side in the sheet conveyance direction. However, the configuration of the bypass separation mechanism is not limited to the above-described configuration. That is, other known configurations are employed, for example, a configuration in which a belt and a roller form a separation nip region and a configuration in which a roller that applies a sheet conveyance force and a separation pad that hinders movement of a sheet in the sheet conveyance direction form a separation nip region.

A sheet feeding device provided in the image forming apparatus 100 includes the in-house sheet feed trays 103 in a housing of the printing device 101. Each of the in-house sheet feed trays 103 contains a sheet S or sheets S of a regular size. Further, the printing device 101 includes the bypass sheet feeding device 105 to perform a printing operation to a sheet having a size larger than the in-house sheet feed trays 103 or a small number of sheets S. The bypass sheet feeding device 105 includes the bypass sheet feed tray 104 to manually load the sheet S for conveying the sheet S from the bypass sheet feed tray 104.

Next, a description is given of the configuration of a sheet feeding device 30 that functions as a sheet feeding device applicable to the bypass sheet feeding device 105 according to the present embodiment.

FIG. 1 is a perspective view illustrating a main part of the sheet feeding device 30 according to an embodiment of this disclosure.

Figure 4:
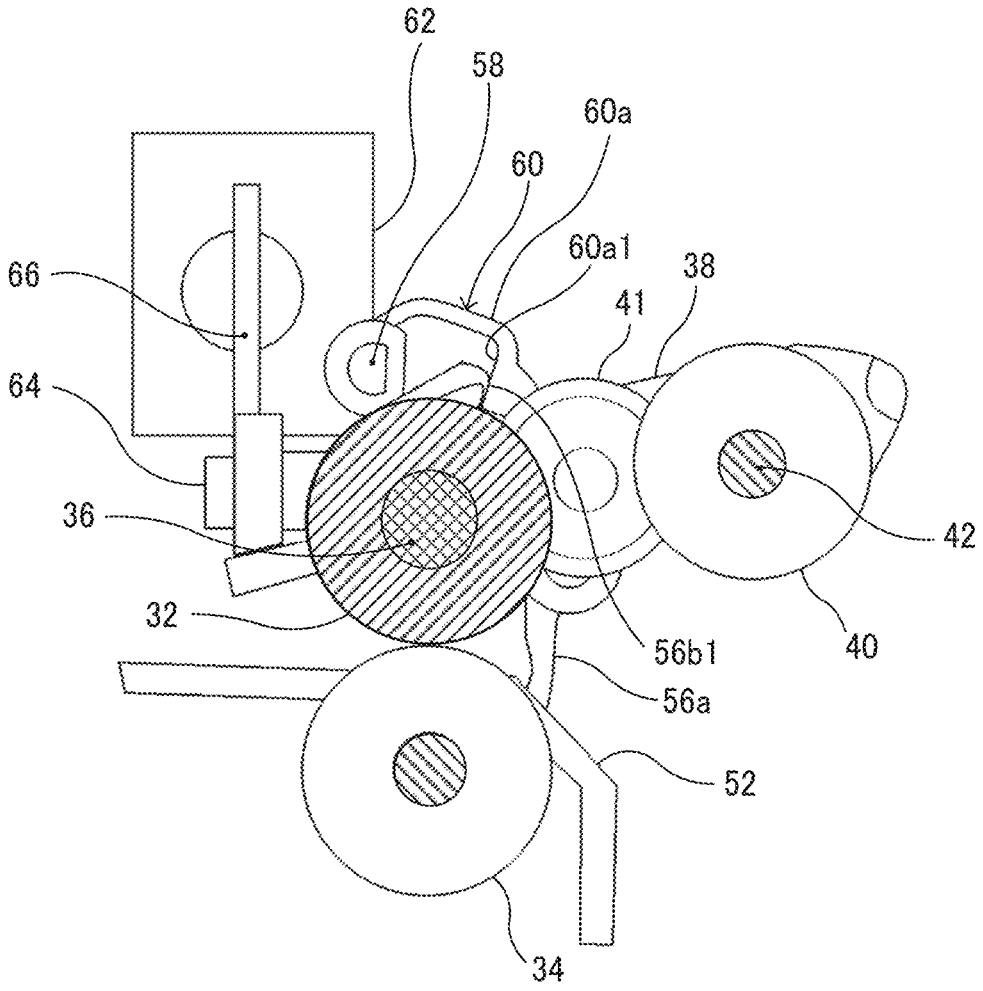
FIG. 4 is a cross-sectional view of a cross section of an area A of the sheet feeding device of FIG. 1.

FIG. 4 is a cross-sectional view of a cross section of an area. A of the sheet feeding device 30 of FIG. 1.

Figure 5:
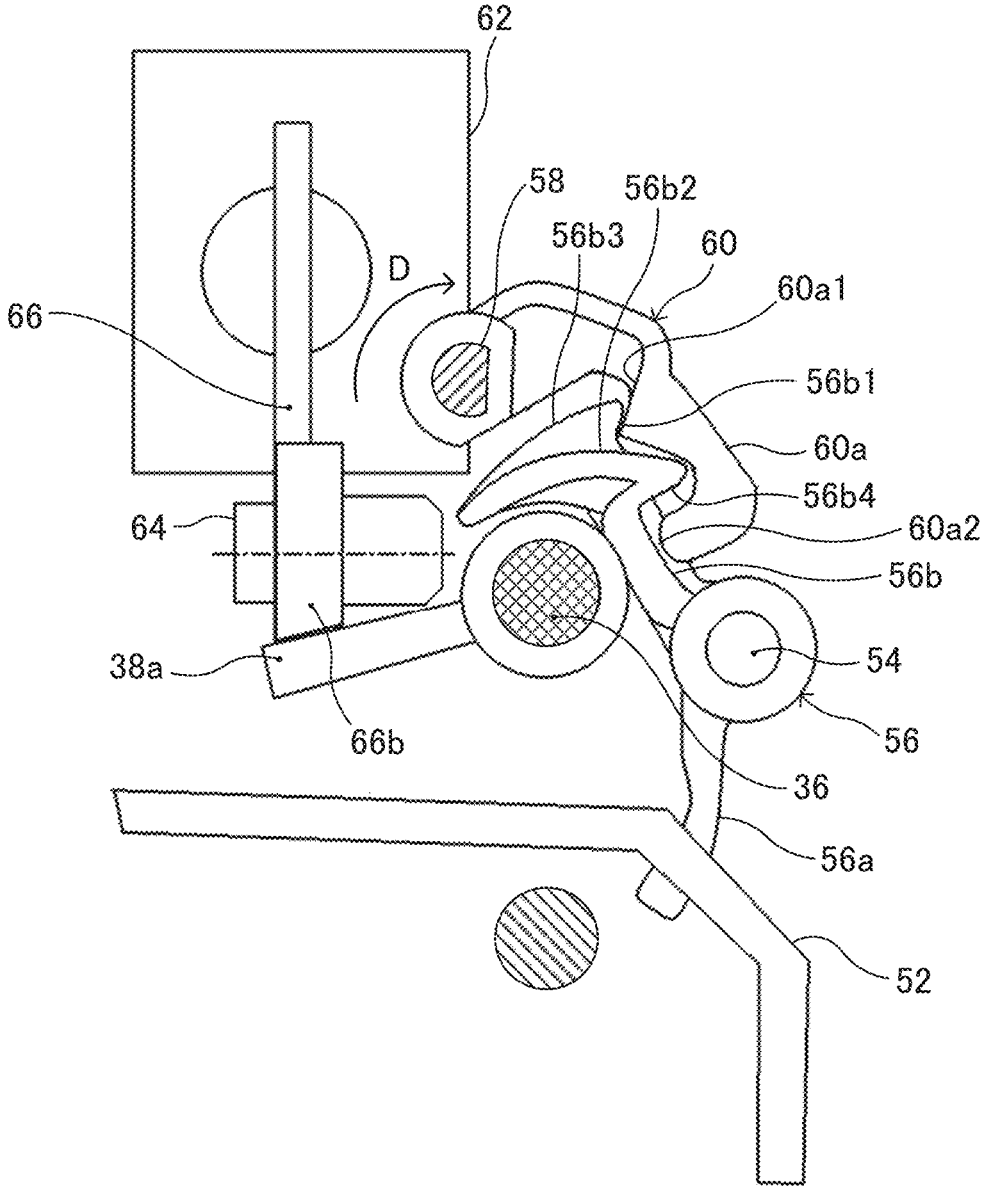
FIG. 5 is a cross-sectional view of a cross section of an area B of the sheet feeding device of FIG. 1.

FIG. 5 is a cross-sectional view of a cross section of an area B of the sheet feeding device 30 of FIG. 1.

Figure 6:
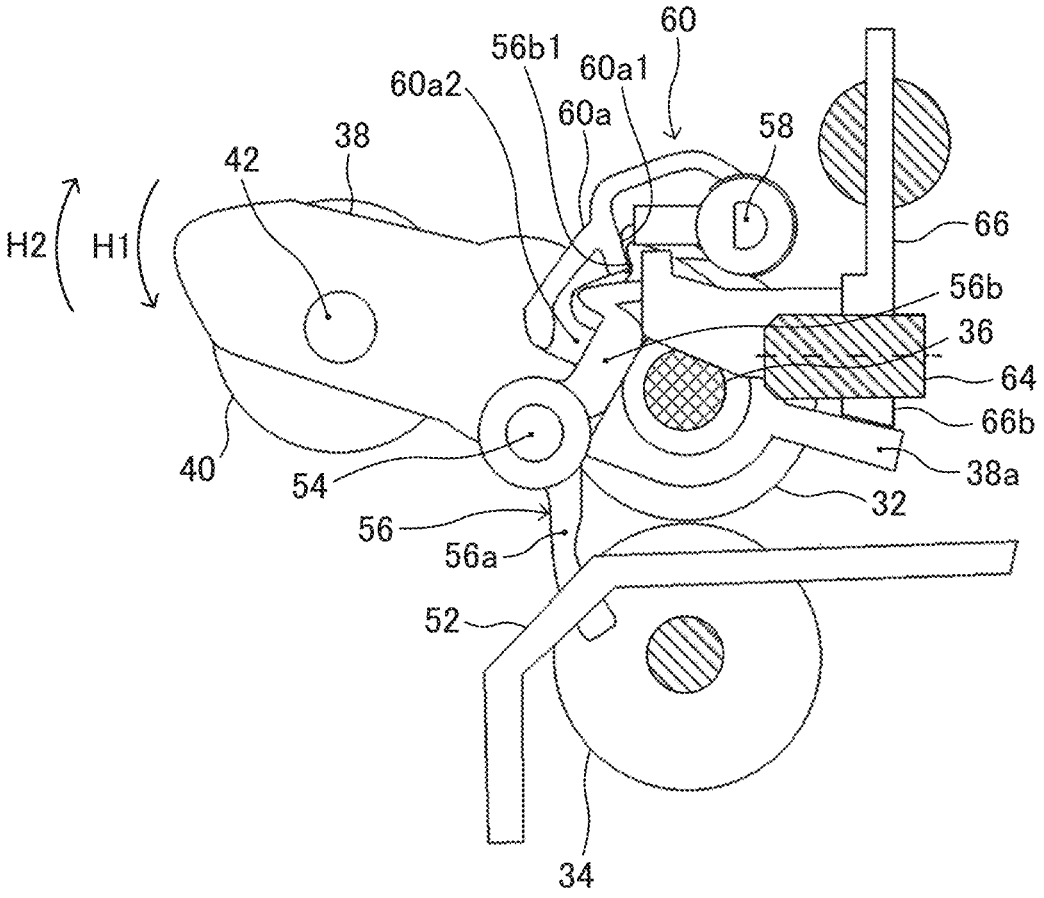
FIG. 6 is a cross-sectional view of a cross section of an area C of the sheet feeding device of FIG. 1.

FIG. 6 is a cross-sectional view of a cross section of an area. C of the sheet feeding device 30 of FIG. 1.

The sheet feeding device 30 includes the sheet feed roller 32 and the sheet separation roller 34. The sheet feeding device 30 further includes a sheet pickup arm 38 having one end supported by a sheet feed roller shaft 36 that is a rotary shaft of the sheet feed roller 32 to rotate about the sheet feed roller shaft 36. A pickup roller shaft 42 is disposed at an opposed end of the sheet pickup arm 38. The sheet pickup roller 40 is rotatably supported to the pickup roller shaft 42.

The sheet pickup roller 40 is coupled to the sheet feed roller 32 via a drive transmission gear 41. The controller 150 illustrated in the block diagram of FIG. 3 drives a sheet feed motor 140 to rotate the sheet feed roller 32. Then, the sheet pickup roller 40 rotates along with rotation of the sheet feed roller 32. A torsion spring is mounted on the pickup roller shaft 42. The sheet pickup arm 38 is biased by the torsion spring, so that the opposed end of the sheet pickup arm 38 (on the side of the sheet pickup roller 40) rotates downwardly.

The bypass sheet feed tray 104 is located below the sheet pickup roller 40. In FIGS. 1 and 4 to 6, the bypass sheet feed tray 104 is omitted conveniently to simplify the drawings. A sheet conveyance guide 52 is disposed downstream from the bypass sheet feed tray 104 in the sheet conveyance direction (in other words, to the left side direction of FIG. 4). The sheet conveyance guide 52 guides the sheet S that is conveyed from the bypass sheet feed tray 104, to the separation nip region where the sheet feed roller 32 and the sheet separation roller 34 contact to each other.

As illustrated in FIG. 3, the controller 150 is electrically connected to a sheet detection sensor 160, a solenoid 62, and the sheet feed motor 140, which are provided in the sheet feeding device 30, so that the controller 150 controls the operations of the sheet detection sensor 160, the solenoid 62, and the sheet feed motor 140. The sheet detection sensor 160 is a sensor to detect presence or absence of the sheet S on the bypass sheet feed tray 104.

A sheet stopper 56 is disposed above space between the bypass sheet feed tray 104 and the sheet conveyance guide 52. The sheet stopper 56 that functions as a contact member that is rotatably supported by a sheet stopper shaft 54 that is fixed to the housing of the sheet feeding device 30. The sheet stopper 56 includes a first stopper arm 56*a* and a second stopper arm 56*b*. The first stopper arm 56*a* and the second stopper arm 56*b* extend in a direction (i.e., a direction parallel to a Z-X plane) perpendicular to a longitudinal direction (i.e., a Y-axis direction) of the sheet stopper shaft 54. The first stopper arm 56*a* and the second stopper arm 56*b* extend from the sheet stopper shaft 54 in respective directions different from each other.

As illustrated in FIG. 5, a sheet stopper rotation regulating member 60 is disposed above the sheet stopper 56. The sheet stopper rotation regulating member 60 that functions as a lock member that is rotatably supported by a regulating member shaft 58 that is fixed to the housing of the sheet feeding device 30. The sheet stopper rotation regulating member 60 includes a regulating member arm 60*a* that extends in a vertical direction to the longitudinal direction of the regulating member shaft 58. As illustrated in FIG. 5, the regulating member arm 60*a* includes a locking portion 60*a*1 so as to lock a locking target portion 56*b*1 of the second stopper arm 56*b* of the sheet stopper 56.

The sheet stopper 56 illustrated in FIG. 5 is located at a position at which the first stopper arm 56*a* stands by to stop a leading end of the sheet S when a bundle of sheets S contacts the bypass sheet feed tray 104 to be loaded. Hereinafter, this position is referred to as a "contact position". That is, even if the sheet stopper 56 is pushed by the leading end of the sheet S to rotate in a counterclockwise direction in FIG. 5, the locking target portion 56*b*1 of the second stopper arm 56*b* is locked by the locking portion 60*a*1 of the regulating member arm 60*a* of the sheet stopper rotation regulating member 60. Therefore, the sheet stopper 56 does not rotate in the counterclockwise direction, and the sheet stopper 56 is remained at the contact position.

Further, the sheet stopper rotation regulating member 60 is biased by a regulating member biasing torsion spring to rotate in a direction indicated by arrow D (i.e., a clockwise direction) in FIG. 5. The regulating member biasing torsion spring functions as a biasing member. The biasing member to bias the sheet stopper rotation regulating member 60 to rotate is not limited to a torsion spring but may be any elastic member such as different types of springs. Alternatively, a biasing force same as the biasing force of the regulating member biasing torsion spring may be applied due to gravity according to a positional relation of a position of a center of gravity of the sheet stopper rotation regulating member 60 and the regulating member shaft 58.

Figure 7A:
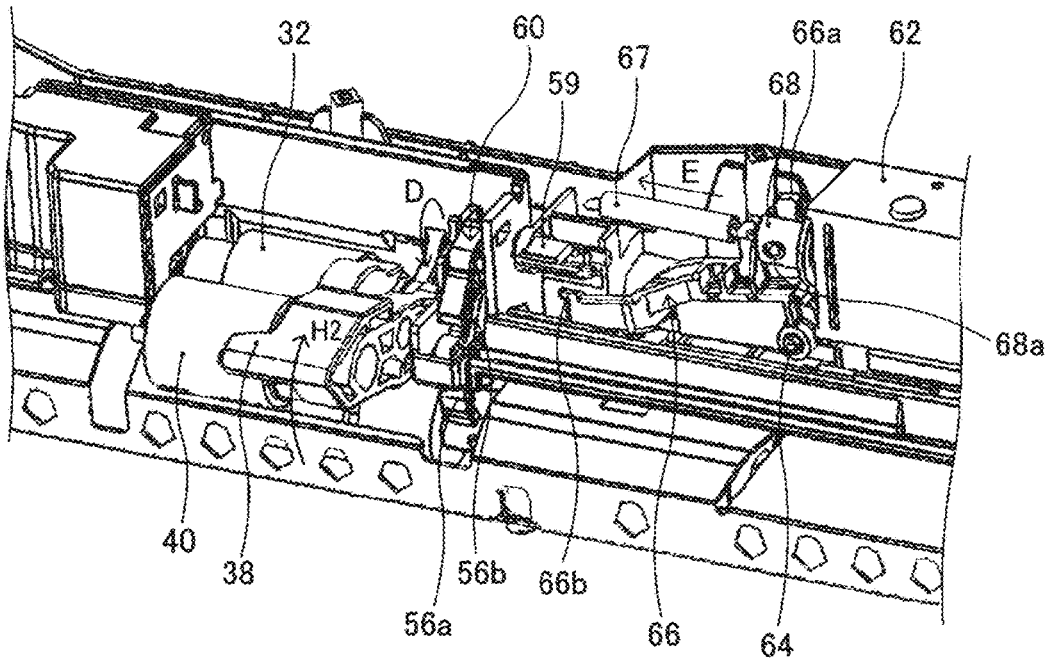
FIG. 7A is a perspective view illustrating a sheet stopper according to an embodiment of this disclosure, in a state in which the sheet stopper is located at a contact position.
Figure 7B:
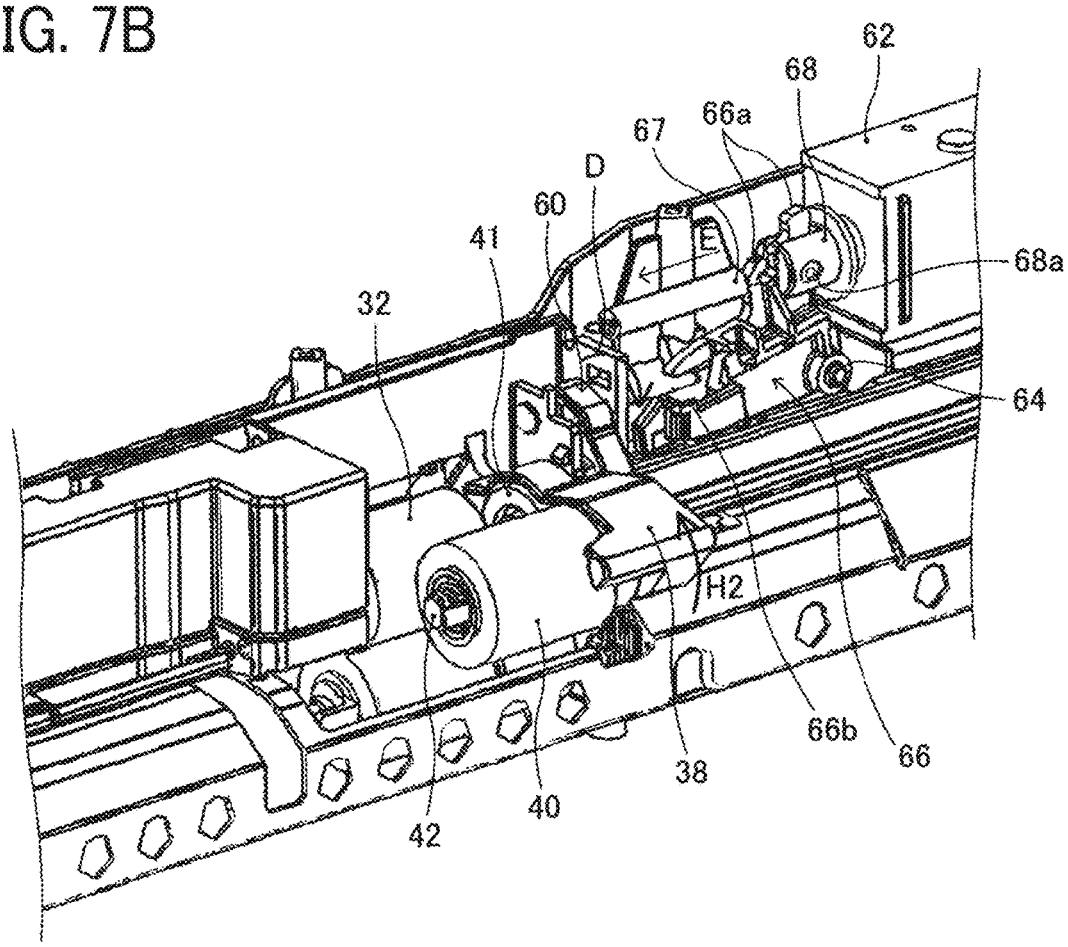
FIG. 7B is a perspective view illustrating the sheet stopper of FIG. 7A, viewed from a different direction.

FIG. 7A is a perspective view illustrating the sheet stopper 56 according to an embodiment of this disclosure, in a state in which the sheet stopper 56 is located at a contact position. FIG. 7B is a perspective view illustrating the sheet stopper 56 of FIG. 7A, viewed from a different direction. In the states of FIGS. 7A and 7B, the solenoid 62 is in an OFF state.

Figure 8A:
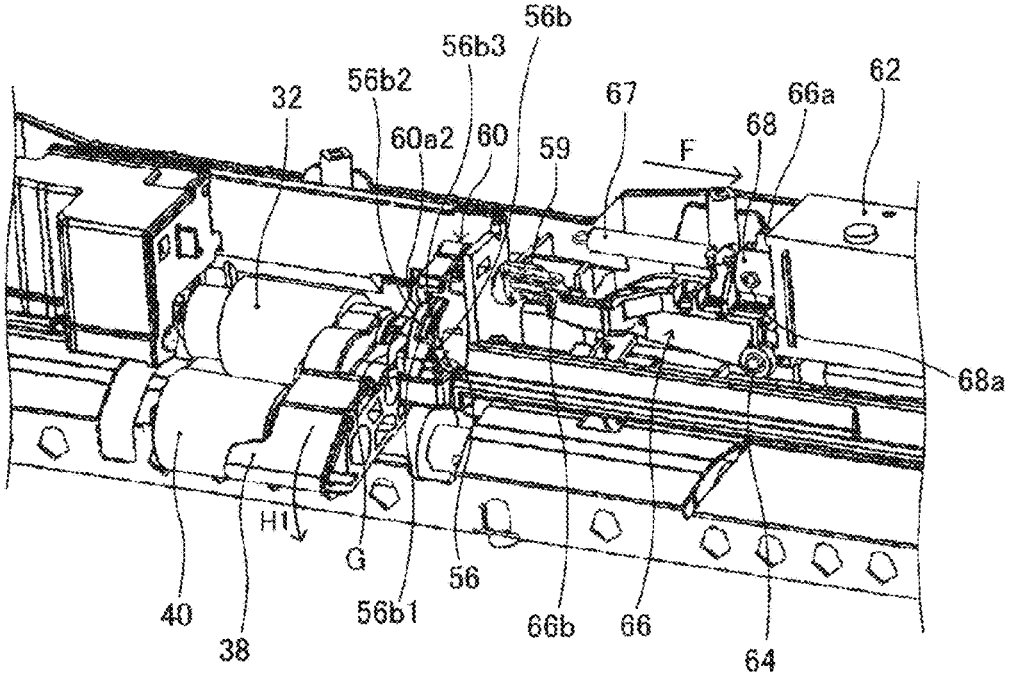
FIG. 8A is a perspective view illustrating a sheet stopper according to an embodiment of this disclosure, in a state in which the sheet stopper is located at a retracted position.
Figure 8B:
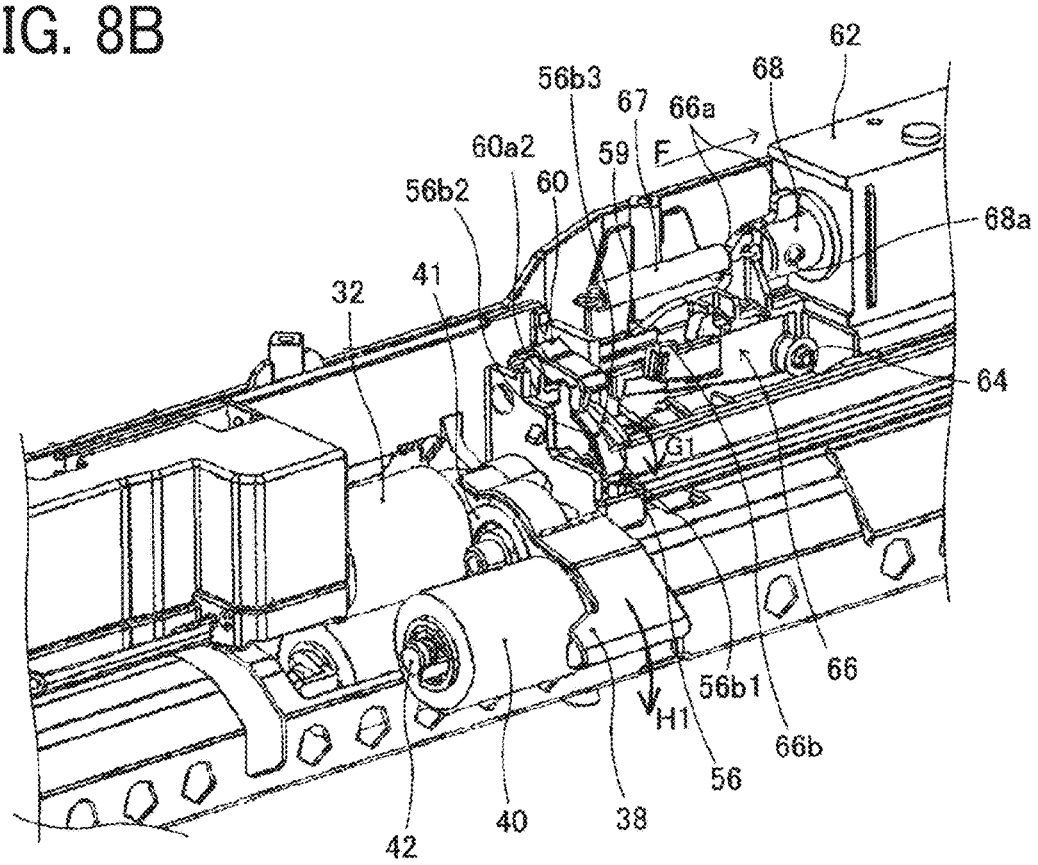
FIG. 8B is a perspective view illustrating the sheet stopper of FIG. 8A, viewed from a different direction.

FIG. 8A is a perspective view illustrating the sheet stopper 56 according to an embodiment of this disclosure, in a state in which the sheet stopper 56 is located at a retracted position. FIG. 8B is a perspective view illustrating the sheet stopper 56 of FIG. 8A, viewed from a different direction. In the states of FIGS. 8A and 8B, the solenoid 62 is in an ON state.

Figure 9A:
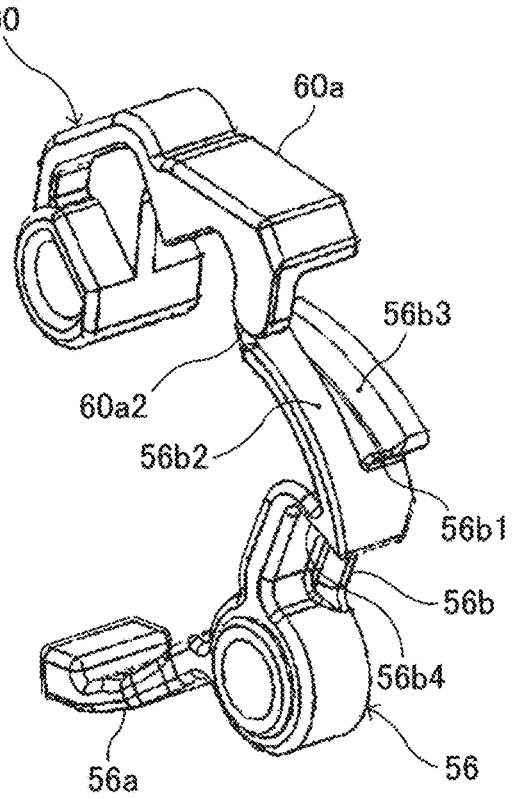
FIG. 9A is a perspective view illustrating the sheet stopper according to an embodiment of this disclosure, in a state in which a sliding target surface of the sheet stopper and a sliding projection of a sheet stopper rotation regulating member are in contact with each other.
Figure 9B:
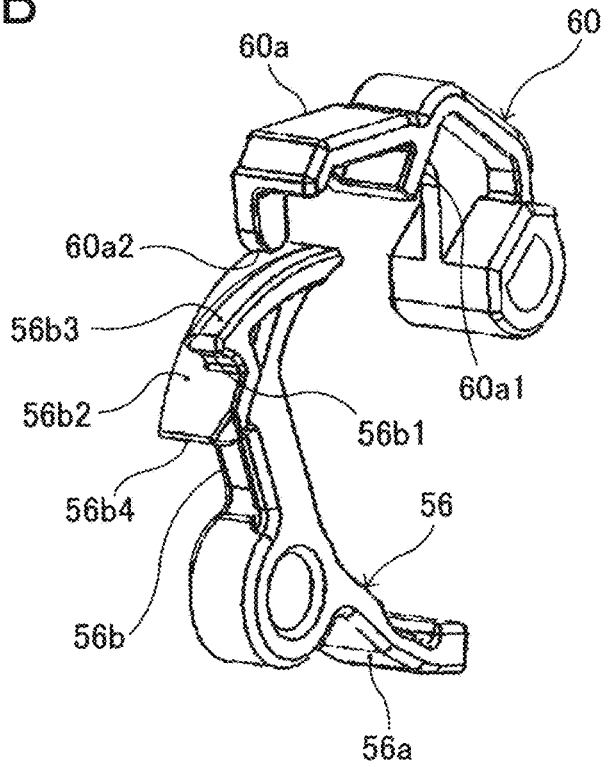
FIG. 9B is a perspective view illustrating the sheet stopper of FIG. 9A, viewed from a different direction.

FIG. 9A is a perspective view illustrating the sheet stopper 56 according to an embodiment of this disclosure, in a state in which a sliding target surface 56*b*2 of the sheet stopper 56 and a sliding projection 60*a*2 of the sheet stopper rotation regulating member 60 are in contact with each other. FIG. 9B is a perspective view illustrating the sheet stopper 56 of FIG. 9A, viewed from a different direction.

The sheet feeding device 30 includes the solenoid 62 and a solenoid link 66 that is rotatably supported by a link support shaft 64 that is fixed to the housing of the sheet feeding device 30. The solenoid link 66 includes a coupling portion 66*a* that is connected to a movable iron core 68 of the solenoid 62. The connecting portion 66*a* is coupled to the movable iron core 68 of the solenoid 62 to rotate about a rotary shaft 68*a* that extends perpendicular to a direction of movement of the movable iron core 68. A tension spring 67 has one end that is supported by the housing. An opposed end of the tension spring 67 is attached to the coupling portion 66*a* of the solenoid link 66 to bias the coupling portion 66*a* in a direction indicated by arrow E in FIGS. 7A and 7B.

When the solenoid 62 is turned on, the movable iron core 68 is pulled into the housing of the solenoid 62, as indicated by arrow F in FIGS. 8A and 8B. Along with this movement, the coupling portion 66*a* of the solenoid link 66 moves against the biasing force of the tension spring 67. According to this operation, the solenoid link 66 rotates about the link support shaft 64 in the clockwise direction in FIGS. 8A and 8B.

On the other hand, when the solenoid 62 is turned off, the coupling portion 66*a* of the solenoid link 66 moves in a direction, as indicated by arrow E in FIGS. 7A and 7B, in which the movable iron core 68 is pulled out from the housing of the solenoid 62 due to the biasing force of the tension spring 67. According to this operation, the solenoid link 66 rotates about the link support shaft 64 in the counterclockwise direction in FIGS. 7A and 7B.

Further, the solenoid link 66 includes a vertically moving portion 66*b* that pushes up a push-up target portion 59 provided integrally with the sheet stopper rotation regulating member 60 that is rotatably supported by the regulating member shaft 58. When the solenoid 62 is turned on and the solenoid link 66 rotates about the link support shaft 64 in the clockwise direction in FIGS. 8A and 8B, the vertically moving portion 66*b* of the solenoid link 66 moves upward to push up the push-up target portion 59 that is an integral unit with the sheet stopper rotation regulating member 60, against the biasing force of the regulating member biasing torsion spring. According to this operation, the sheet stopper rotation regulating member 60 rotates about the regulating member shaft 58 in a direction in which the regulating member arm 60*a* moves upwardly. That is, the sheet stopper rotation regulating member 60 rotates from the locked position at which the locking portion 60*a*1 of the sheet stopper rotation regulating member 60 locks the locking target portion 56*b*1 of the second stopper arm 56*b* of the sheet stopper 56 (i.e., the locked state illustrated in FIGS. 7A and 7B), to the locking release position at which the above-described state is canceled (i.e., the locking released state illustrated in FIGS. 8A and 8B).

The sheet stopper 56 is thus released from the above-described locked state by the sheet stopper rotation regulating member 60, so that the sheet stopper 56 is brought to be rotatable about the sheet stopper shaft 54, from the contact position at which the first stopper arm 56*a* is in contact with the sheet S (i.e., the state illustrated in FIGS. 7A and 7B), to the retracted position at which the first stopper arm 56*a* is spaced apart from the sheet S (i.e., the state illustrated in FIGS. 8A and 8B). Consequently, the sheet feeding operation starts, the leading end of the sheet S in the sheet conveyance direction pushes to retract the first stopper arm

56*a*, and therefore the sheet S may be conveyed. Then, as the sheet S is fed and the leading end of the sheet S pushes the first stopper arm 56*a* to retract, the sheet stopper 56 rotates from the contact position to the retracted position, into the state illustrated in FIGS. 8A and 8B.

Further, as illustrated in FIGS. 5 and 6, a push-down target portion 38*a* of the sheet pickup arm 38 is located below the vertically moving portion 66*b* of the solenoid link 66. The push-down target portion 38*a* of the sheet pickup arm 38 extends, relative to the sheet feed roller shaft 36 that rotatably supports the sheet pickup arm 38, in a direction opposite the sheet pickup roller 40. As described above, the sheet pickup arm 38 is rotated and biased by the torsion spring in a direction in which the sheet pickup roller 40 moves downward. Therefore, the push-down target portion 38*a* of the sheet pickup arm 38 is rotated and biased in a direction to move upward.

When the solenoid 62 is turned on, the vertically moving portion 66*b* of the solenoid link 66, which has pressed the push-down target portion 38*a* that has been biased upward by the torsion spring, moves upward. With this movement, the sheet pickup arm 38 rotates due to the biasing force of the torsion spring in a direction indicated by arrow H1 in FIG. 6. As a result, the sheet pickup roller 40 that is supported by the sheet pickup arm 38 moves downward, so that the sheet pickup roller 40 is brought into contact with an upper face of the uppermost sheet S set on the bypass sheet feed tray 104. In this state, as the sheet feed motor 140 drives and rotates the sheet pickup roller 40 that is coupled to the sheet feed roller 32, the uppermost sheet S set on the bypass sheet feed tray 104 is fed to the separation nip region.

On the other hand, when the solenoid 62 is turned off and the solenoid link 66 rotates about the link support shaft 64 in the counterclockwise direction in FIGS. 7A and 7B, the vertically moving portion 66*b* of the solenoid link 66 moves downward. Thus, the push-down target portion 38*a* of the sheet pickup arm 38 is brought into contact with the vertically moving portion 66*b* to be pressed down, and the sheet pickup arm 38 rotates in a direction indicated by arrow H2 in FIG. 6, against the biasing force of the torsion spring. As a result, the sheet pickup roller 40 that is supported by the sheet pickup arm 38 moves upward, so that the sheet pickup roller 40 is separated from the upper face of the sheet S set on the bypass sheet feed tray 104.

Further, when the solenoid 62 is turned off and the vertically moving portion 66*b* of the solenoid link 66 moves downward, the vertically moving portion 66*b* of the solenoid link 66 is separated from the lower face of the push-up target portion 59 of the sheet stopper rotation regulating member 60. Accordingly, the sheet stopper rotation regulating member 60 comes to rotate in a direction indicated by arrow D in FIGS. 7A and 7B, due to the biasing force of the regulating member biasing torsion spring.

At this time, in a case in which the sheet stopper 56 is rotated to the contact position (i.e., the state illustrated in FIGS. 7A and 7B), the sheet stopper rotation regulating member 60 rotates to the locking position at which the locking portion 60*a*1 of the sheet stopper rotation regulating member 60 locks the locking target portion 56*b*1 of the second stopper arm 56*b* of the sheet stopper 56. On the other hand, in a case in which the leading end of the sheet S is pressed to retract the first stopper arm 56*a* and therefore the sheet stopper 56 is rotated to the retracted position (i.e., the state illustrated in FIGS. 8A and 8B), the sliding projection 60*a*2, which functions as a sliding portion mounted on a tip of the regulating member arm 60*a* of the sheet stopper rotation regulating member 60, contacts the sliding target surface 56*b*2 that functions as a sliding target portion mounted on the second stopper arm 56*b* of the sheet stopper 56. In this case, the sheet stopper rotation regulating member 60 does not reach the locking position.

The sheet stopper 56 according to the present embodiment receives a biasing force to return from the retracted position to the contact position (i.e., a biasing force in a direction indicated by arrow G in FIG. 8A) that is applied due to gravity, according to a positional relation of a position of a center of gravity of the sheet stopper 56 and the sheet stopper shaft 54. Instead of the above-described configuration, a biasing member such as a spring may be provided to the sheet stopper 56 so that a biasing force that is similar to the above-described biasing force (in other words, a rotational force) is applied. By application of such a biasing force (a rotational force), the sheet feeding operation of the sheet S set on the bypass sheet feed tray 104 is started, the leading end of the sheet S presses the first stopper arm 56*a* to rotate the sheet stopper 56 to the retracted position (in a direction indicated by arrow G1 in FIG. 8B). Thereafter, in a case in which no sheet S is present below the first stopper arm 56*a*, the sheet stopper 56 rotates from the retracted position to the contact position due to gravity. However, when the sheet feeding operation starts, the plurality of sheets S are usually conveyed in an overlapping manner to the separation nip region between the sheet feed roller 32 and the sheet separation roller 34. Therefore, even after the uppermost sheet S is separated and conveyed due to the operation at the separation nip region, the sheet S continuously remains below the first stopper arm 56*a*. Therefore, generally, until no sheet S is left on the bypass sheet feed tray 104, the tip of the first stopper arm 56*a* of the sheet stopper 56 contacts the upper face of the sheet S below the tip, that prevents the sheet stopper 56 from rotating to the contact position.

In a case in which no sheet S is left on the bypass sheet feed tray 104, no sheet S resides below the first stopper arm 56*a*. Accordingly, the sheet stopper 56 rotates from the retracted position to the contact position due to gravity. At this time, since the solenoid 62 is turned off, the sliding projection 60*a*2 of the sheet stopper rotation regulating member 60 is in contact with the sliding target surface 56*b*2 of the sheet stopper 56 due to the biasing force of the regulating member biasing torsion spring. Therefore, the sheet stopper 56 rotates from the retracted position to the contact position, in a state in which the sliding projection 60*a*2 slides on the sliding target surface 56*b*2. Therefore, when the sheet stopper 56 rotates from the retracted position to the contact position, the sheet stopper 56 receives rotation resistance due to a frictional force between the sliding projection 60*a*2 and the sliding target surface 56*b*2.

As the sheet stopper 56 rotates from the retracted position to the contact position, the sliding projection 60*a*2 of the sheet stopper rotation regulating member 60 reaches a downstream end of the sliding target surface 56*b*2 in a sliding direction of the sliding target surface 56*b*2. As illustrated in FIG. 5, a step 56*b*4 is provided on the downstream side of the downstream end in the sliding direction of the sliding target surface 56*b*2. Therefore, when the sliding projection 60*a*2 of the sheet stopper rotation regulating member 60 reaches the downstream end of the sliding target surface 56*b*2 in the sliding direction, the sliding projection 60*a*2 is hooked down to the step 56*b*4 due to the biasing force of the regulating member biasing torsion spring, so that the sheet stopper rotation regulating member 60 rotates.

As a result of this rotation, the locking portion 60*a*1 of the sheet stopper rotation regulating member 60 is brought to a position to lock the locking target portion 56*b*1 of the second stopper arm 56*b* of the sheet stopper 56 (in other words, a position at which the sheet stopper 56 is disposed facing the locking target portion 56*b*1 in the rotational direction from the contact position to the retracted position). That is, the sheet stopper rotation regulating member 60 rotates from the locking release position to the locking position. As a result, the sheet stopper 56 that has rotated to the contact position is restricted from rotating to the retracted position. Therefore, even though the sheet stopper 56 is pressed by the leading end of the sheet S to rotate in the counterclockwise direction illustrated in FIG. 5, the locking target portion 56*b*1 of the second stopper arm 56*b* is locked by the locking portion 60*a*1 of the regulating member arm 60*a* of the sheet stopper rotation regulating member 60. Accordingly, the sheet stopper 56 does not rotate in the counterclockwise direction, and the sheet stopper 56 is remained at the contact position.

A series of sheet feeding operations performed in the sheet feeding device 30 according to the present embodiment is summarized as follows.

When the sheet feeding operation is stopped, the solenoid 62 is turned off and, as illustrated in FIGS. 7A and 7B, the movable iron core 68 is pulled from the housing of the solenoid 62 due to the biasing force of the tension spring 67 (that is, in a state in which the movable iron core 68 is pulled in the direction indicated by arrow E in FIGS. 7A and 7B). At this time, the solenoid link 66 rotates about the link support shaft 64 in the counterclockwise direction illustrated in FIGS. 7A and 7B, and the vertically moving portion 66*b* of the solenoid link 66 is lowered. Accordingly, the push-down target portion 38*a* of the sheet pickup arm 38 is pressed down by the vertically moving portion 66*b* of the solenoid link 66, the sheet pickup arm 38 rotates in the direction indicated by arrow H2 in FIG. 6, and the sheet pickup roller 40 is lifted.

Further, when the sheet feeding operation is stopped, the sheet stopper 56 has rotated to the contact position (i.e., the state illustrated in FIGS. 7A and 7B). At this time, the sheet stopper rotation regulating member 60 has rotated to the locking position at which the locking portion 60*a*1 of the sheet stopper rotation regulating member 60 locks the locking target portion 56*b*1 of the sheet stopper 56. For this reason, even in a case in which the bundle of sheets S is set on the bypass sheet feed tray 104 with the bundle of sheets S being stuck in the sheet conveyance direction, the leading end of the bundle of sheets S contacts the first stopper arm 56*a* of the sheet stopper 56, and therefore the sheet S is prevented from being pressed into the separation nip region between the sheet feed roller 32 and the sheet separation roller 34.

As the bundle of sheets S set on the bypass sheet feed tray 104 is inserted into the separation nip region manually with great force, it is likely that the number of sheets S that enters the separation nip region becomes greater than the maximum number of conveyable sheets S that is estimated to reach the separation nip region. If the sheets S are fed in this state, the sheets S are not sufficiently separated in the separation nip region. Therefore, it is likely to cause the multiple feeding failure in which the plurality of sheets S is fed into the sheet conveyance passage in the printing device 101. In addition, skew is likely to occur when the bundle of sheets S is inserted into the separation nip region manually while the bundle of sheets S is slanted. Further, when the bundle of sheets S is inserted manually with great force into the separation nip region, the sheet feed roller 32 or the sheet separation roller 34 bends the leading end of the bundle of sheets S, which is likely to result in deterioration of print quality or in occurrence of the paper jam while printing.

In the sheet feeding device 30 according to the present embodiment, even when the bundle of sheets S to be set on the bypass sheet feed tray 104 is inserted manually into the separation nip region, the bundle of sheets S contacts the first stopper arm 56*a* of the sheet stopper 56 that is locked by the sheet stopper rotation regulating member 60, and therefore the bundle of sheet S is prevented from further entering to the downward side in the sheet conveyance direction. This configuration prevents a case in which the bundle of sheets S is inserted into the separation nip region, thereby preventing failures such as the above-described multiple feeding failure, the deterioration of print quality, and occurrence of paper jam during the printing operation. Further, by aligning the position of the leading end of the sheet S with the sheet stopper 56, occurrence of skew is prevented.

When a print job starts, prior to the sheet feeding operation, the controller 150 starts driving the sheet feed motor 140 to rotate the sheet feed roller 32. Along with the rotation of the sheet feed roller 32, the driving force is transmitted to the sheet pickup roller 40 via the drive transmission gear 41, so that the sheet pickup roller 40 that has been lifted also rotates. In addition, the sheet separation roller 34 having the surface in contact with the surface of the sheet feed roller 32 is rotated along with the rotation of the sheet feed roller 32.

Thereafter, when the controller 150 turns on the solenoid 62, the movable iron core 68 is pulled toward the housing of the solenoid 62 against the biasing force of the tension spring 67 (in the direction indicated by arrow F in FIGS. 8A and 8B). With this operation, the solenoid link 66 rotates about the link support shaft 64 in the clockwise direction illustrated in FIGS. 8A and 8B, and the vertically moving portion 66*b* of the solenoid link 66 is lifted. As a result, the push-up target portion 59 of the sheet stopper rotation regulating member 60 is pushed up, so that the sheet stopper rotation regulating member 60 rotates, from the locking position at which the locking portion 60*a*1 of the sheet stopper rotation regulating member 60 locks the locking target portion 56*b*1 of the second stopper arm 56*b* of the sheet stopper 56 (i.e., the state illustrated in FIGS. 7A and 7B), to the locking release position at which the locking of the sheet stopper 56 is cancelled (i.e., the state illustrated in FIGS. 8A and 8B). With this operation, the sheet stopper 56 is brought to be rotatable from the contact position (i.e., the state illustrated in FIGS. 7A and 7B) to the retracted position (i.e., the state illustrated in FIGS. 8A and 8B).

Further, when the solenoid 62 is turned on, the vertically moving portion 66*b* of the solenoid link 66 that has pressed down the push-down target portion 38*a* of the sheet pickup arm 38 is lifted. Therefore, the sheet pickup arm 38 rotates in a direction to lower the sheet pickup roller 40 due to the biasing force of the torsion spring. As a result, the sheet pickup roller 40 during rotation contacts the uppermost sheet S placed on top of the bypass sheet feed tray 104, and the sheet conveyance force in the sheet conveyance direction is applied to the sheet S.

The uppermost sheet S placed on the bypass sheet feed tray 104 is fed out from the bypass sheet feed tray 104 by the sheet pickup roller 40 and is conveyed toward the separation nip region where the sheet feed roller 32 and the sheet separation roller 34 contact with each other. While the sheet S is being conveyed, the sheet S contacts the first stopper arm 56*a* of the sheet stopper 56. However, as described above, the sheet stopper rotation regulating member 60 has rotated to the locking release position, and therefore the locking (in other words, the restriction of rotation) of the sheet stopper 56 is cancelled. Accordingly, the sheet S presses to retract the first stopper arm 56*a*, so that the sheet S passes the contact position contacting with the sheet stopper 56. Therefore, the sheet S is conveyed toward the separation nip region where the sheet feed roller 32 and the sheet separation roller 34 contact each other. As the leading end of the sheet S pushes away the first stopper arm 56*a*, the sheet stopper 56 rotates from the contact position to the retracted position against the biasing force due to gravity.

The controller 150 turns off the solenoid 62 at given timing before the trailing end of the sheet S passes by the sheet pickup roller 40, With this operation, as illustrated in FIGS. 7A and 7B, the movable iron core 68 is pulled out from the housing of the solenoid 62 due to the biasing force of the tension spring 67 (in other words, the state in which the movable iron core 68 is pulled in the direction indicated by arrow E in FIGS. 7A and 7B). As a result, the solenoid link 66 rotates about the link support shaft 64 in the counterclockwise direction in FIGS. 7A and 7B, and the vertically moving portion 66*b* of the solenoid link 66 is lowered. With this operation, the push-down target portion 38*a* of the sheet pickup arm 38 is pressed down by the vertically moving portion 66*b* of the solenoid link 66, and therefore the sheet pickup roller 40 of the sheet pickup arm 38 is returned to a lifted state. After the sheet pickup roller 40 is lifted, the sheet S is conveyed by the sheet feed roller 32.

When the solenoid 62 is turned off, the vertically moving portion 66*b* of the solenoid link 66 is separated from the lower face of the push-up target portion 59 of the sheet stopper rotation regulating member 60. Accordingly, the sheet stopper rotation regulating member 60 is brought into rotation in the direction indicated by arrow D in FIGS. 7A and 7B, due to the biasing force of the regulating member biasing torsion spring. At this time, since the sheet S that has been separated in the separation nip region remains below the first stopper arm 56*a* of the sheet stopper 56, the tip of the first stopper arm 56*a* contacts the upper face of the sheet S. Therefore, the sheet stopper 56 cannot rotate to the contact position, that is, remains at the retracted position. Therefore, as illustrated in FIGS. 8A and 8B, the sliding projection 60*a*2 of the regulating member arm 60*a* of the sheet stopper rotation regulating member 60 contacts the sliding target surface 56*b*2 of the second stopper arm 56*b* of the sheet stopper 56. Therefore, the sheet stopper rotation regulating member 60 does not rotate to the locking position. Accordingly, the sheet stopper 56 is generally located at the retracted position until no sheet S is left on the bypass sheet feed tray 104, and the sheets S set on the bypass sheet feed tray 104 are conveyed sequentially.

Next, a description is given of details of the sheet feeding device 30 according to the present embodiment.

At completion of the sheet feeding operation when no sheet S is left on the bypass sheet feed tray 104, the sheet stopper 56 rotates from the retracted position to the contact position. In response, the sheet stopper rotation regulating member 60 rotates to the locking position. Thus, the sheet stopper 56 is supposed to be restricted from rotating from the contact position to the retracted position. However, when the sheet stopper 56 rotates from the retracted position to the contact position, the sheet stopper 56 is subject to rotational resistance due to the frictional force between the sliding projection 60*a*2 and the sliding target surface 56*b*2. For this reason, in a configuration of a comparative sheet feeding device (also referred to as a comparative configuration), a rotation preventing force that prevents the sheet stopper 56 from rotating from the retracted position to the contact position (for example, the above-described frictional force and a rotational load of a rotary shaft) and a rotation force that causes the sheet stopper 56 to rotate from the retracted position to the contact position (for example, the biasing force due to gravity that acts on the sheet stopper 56) are balanced, which is referred to as a balanced state. In this balanced state, the sheet stopper 56 cannot rotate, and therefore cannot return to the contact position from the retracted position.

Figure 10:
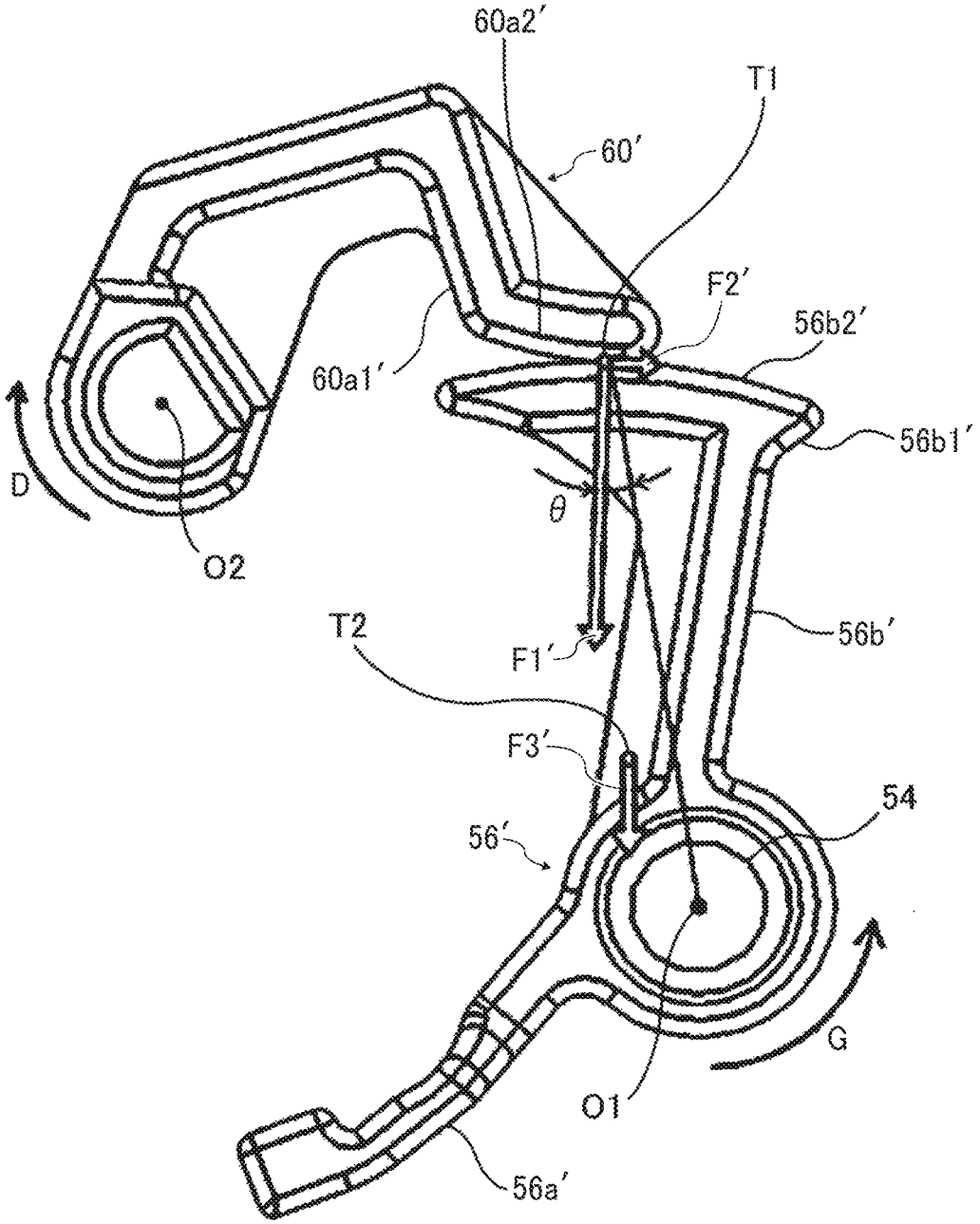
FIG. 10 is a diagram illustrating a sheet stopper and a sheet stopper rotation regulating member of a comparative sheet feeding device, focusing on a force that the sheet stopper receives when the sheet stopper returns to the contact position at completion of a sheet feeding operation.

FIG. 10 is a diagram illustrating a sheet stopper 56' and a sheet stopper rotation regulating member 60' of a comparative sheet feeding device, for explaining a force that the sheet stopper 56' receives when the sheet stopper 56' returns to the contact position at completion of the sheet feeding operation. At completion of the sheet feeding operation, no sheet S is left to contact a first stopper arm 56*a*' of the sheet stopper 56', and therefore the sheet stopper 56' is free to rotate due to gravity, from the retracted position to the contact position. At this time, the sheet stopper rotation regulating member 60' receives the biasing force in the direction indicated by arrow D in FIG. 10 due to the biasing force of the regulating member biasing torsion spring. Therefore, a sliding target surface 56*b*2' of the sheet stopper 56' receives a load F1' from a sliding projection 60*a*2' of the sheet stopper rotation regulating member 60' that contacts the sliding target surface 56*b*2 of the sheet stopper 56'. A load direction of the load F1' matches a rotational direction (in other words, a tangent line direction) about a center of rotation O2 of the sheet stopper rotation regulating member 60' that passes a contact point T1 on the sliding target surface 56*b*2' to which the sliding projection 60*a*2' contacts. It is to be noted that an angle of a direction connecting the contact point T1 and a center of rotation O1 of the sheet stopper 56' and the load direction of the load F1' is referred to as a contact angle θ'.

Further, when the sheet stopper 56' rotates in a direction indicated by arrow G in FIG. 10 toward the contact position, the sheet stopper 56' receives a sliding frictional force F2' of the sliding projection 60*a*2' and the sliding target surface 56*b*2' at the contact point T1.

Further, the sheet stopper 56' receives gravity F3' due to the weight of the sheet stopper 56', at a gravity center position T2 of the sheet stopper 56'.

Figure 11:
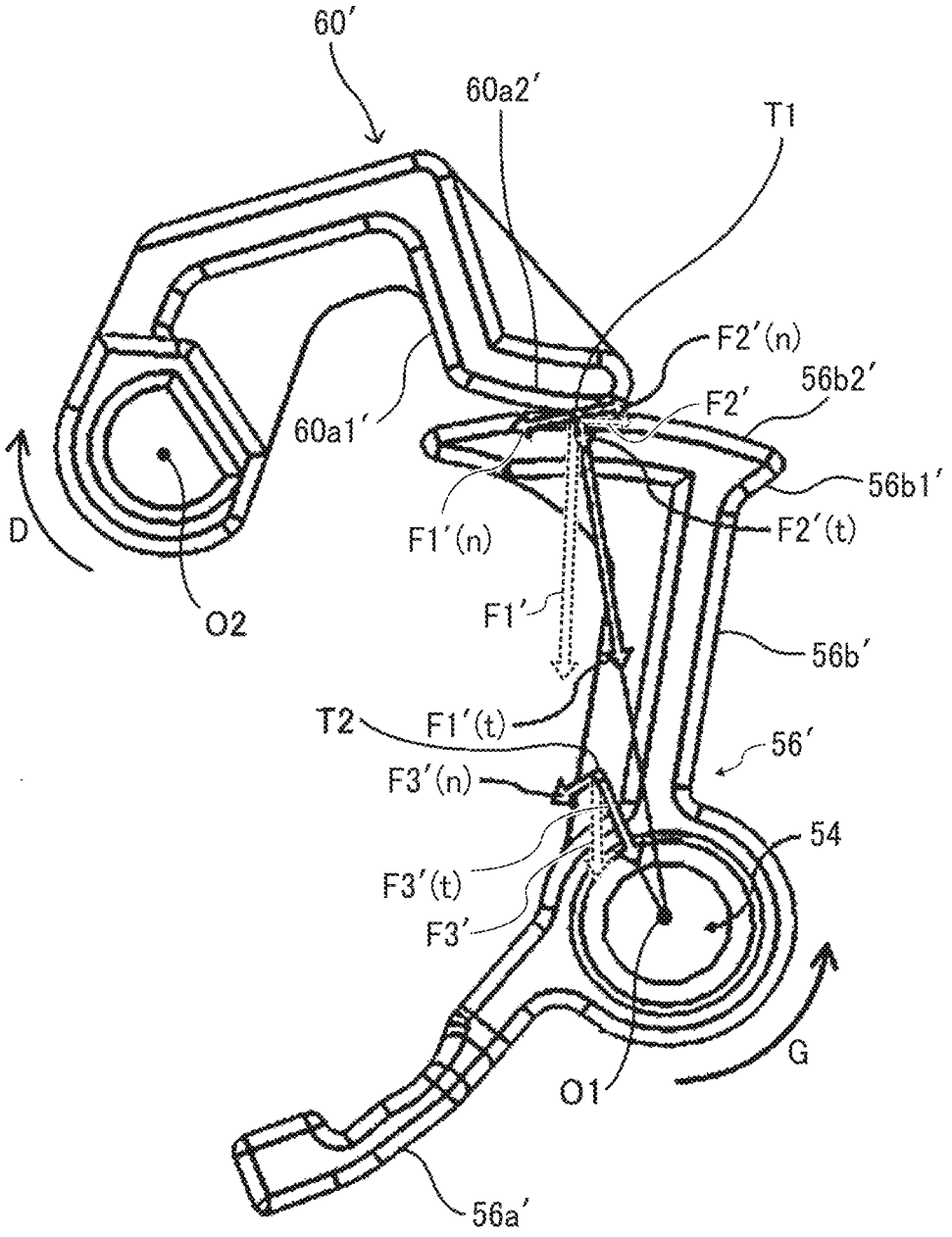
FIG. 11 is a diagram illustrating a component force of the force received by the sheet stopper.

FIG. 11 is a diagram illustrating a component force of the force received the sheet stopper 56'.

Figure 12:
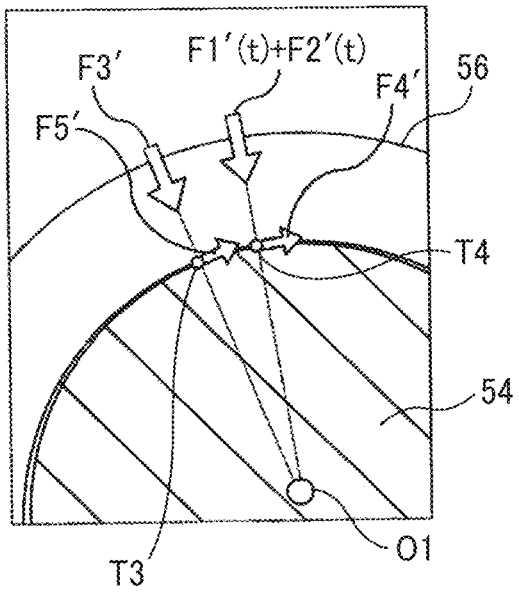
FIG. 12 is a diagram illustrating the sheet stopper for explaining a shaft frictional force received from a circumferential surface of a stopper shaft when the sheet stopper rotates.

The sheet stopper 56' receives forces F1', F2', and F3'. These forces F1', F2', and F3' are decomposed into a tangential component (n) and a normal component (t), with respect to the center of rotation O1 of the sheet stopper 56'. The sheet stopper 56' is rotatably supported by the sheet stopper shaft 54 and slidably rotates with respect to the circumferential surface of the sheet stopper shaft 54. The sheet stopper 56' receives, from the circumferential surface of the sheet stopper shaft 54, a vertical reaction force against the normal component F1(*t*)'+F2(*t*)' of the load F1' and the sliding frictional force F2' acting on the contact point T1 and a vertical reaction force against the normal component F3(*t*)' of the gravity F3' acting on the gravity center position T2. Therefore, as illustrated in FIG. 12, when the sheet stopper 56' rotates in the direction indicated by arrow G in FIG. 10 toward the contact position, the sheet stopper 56' receives an axial frictional force F4' according to the vertical reaction force against the normal component F1(*t*)'+F2(*t*)' on a circumferential surface T4 of the sheet stopper shaft 54 and an axial frictional force F5' according to the vertical reaction force against the normal component F3(*t*)' on a circumferential surface T3 of the sheet stopper shaft 54.

As a result, the rotational force that rotates the sheet stopper 56' from the retracted position to the contact position includes a tangential component F1(*n*)' of the load F1' of the sheet stopper rotation regulating member 60' and a tangential component F3(*n*)' of the gravity F3'. The rotation preventing force that prevents the sheet stopper 56' from rotating from the retracted position to the contact position includes a tangential component F2(*n*)' of the sliding frictional force F2' acting on the sliding target surface 56*b*2' and the axial frictional forces F4' and F5' acting on the contact surface of the sheet stopper shaft 54.

Figure 13:
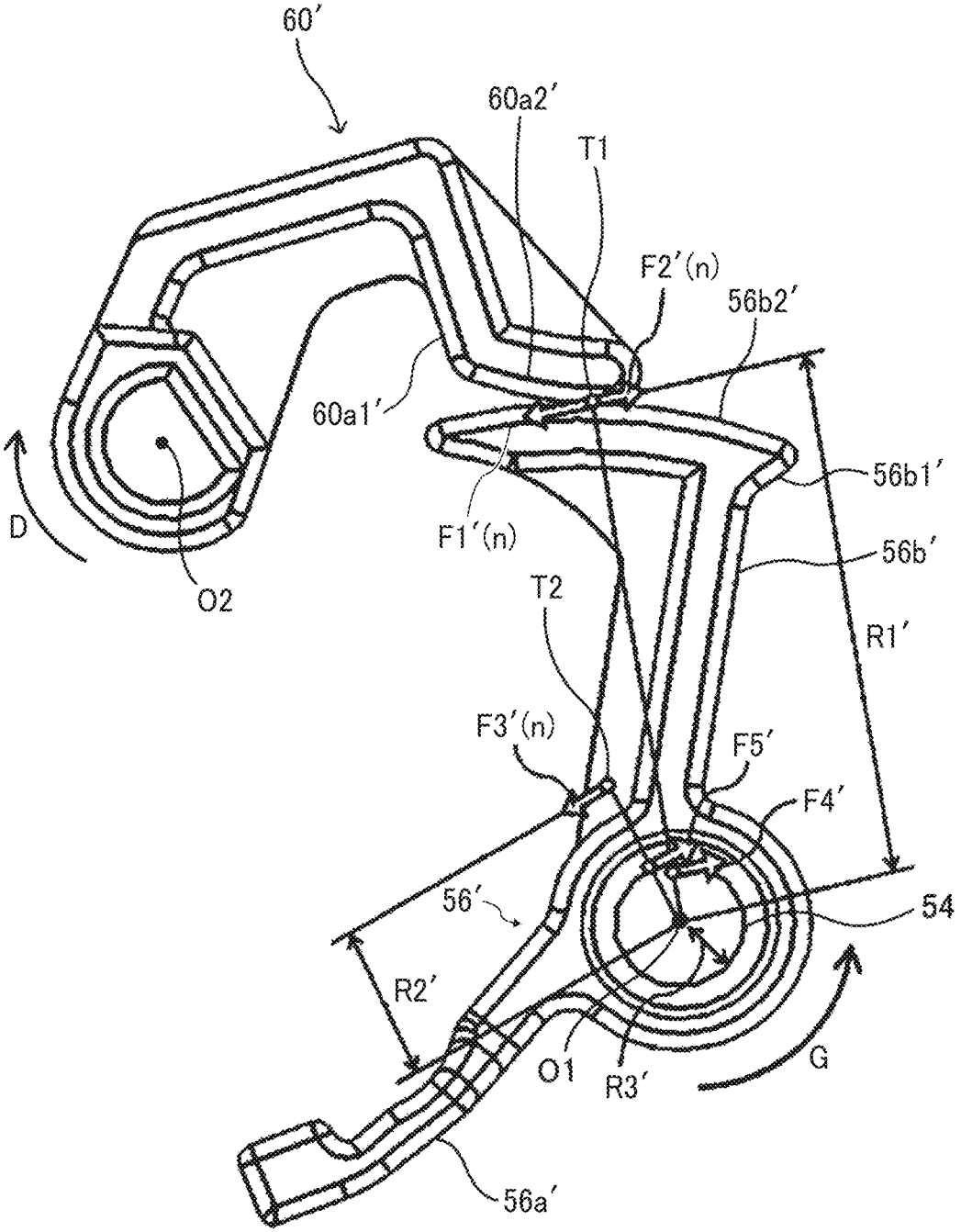
FIG. 13 is a diagram illustrating the sheet stopper for explaining conditions for returning the sheet stopper to the contact position.

FIG. 13 is a diagram illustrating the sheet stopper 56' for explaining conditions for returning the sheet stopper 56' to the contact position.

The distance from the center of rotation O1 of the sheet stopper 56' to the point T1 on which the rotational force F1(*n*)' and the rotation preventing force F2(*n*)' act is referred to as a distance R1'. The distance from the center of rotation O1 of the sheet stopper 56' to the point T2 on which the rotational force F3(*n*)' acts is a distance R2'. The distance from the center of rotation O1 of the sheet stopper 56' to the point T3 on which the rotation preventing force F5' acts or to the point T4 on which the rotation preventing force F4' acts is a distance R3'. In this case, the following conditional equation, which is Equation (1), is constantly satisfied in order to cause the sheet stopper 56' to rotate in the direction G to return to the contact position after completion of the sheet feeding operation:

$$R1'\times(F1(n)'-F2(n)')+R2'\times F3(n)'-R3'\times(F4'+F5')>0 \qquad \text{Equation (1).}$$

FIGS. 14A to 14D are diagrams illustrating the comparative sheet stopper 56' for explaining the load F1' acting on the contact point T1 while the comparative sheet stopper 56' rotates from the retracted position to the contact position.

Figure 14B:
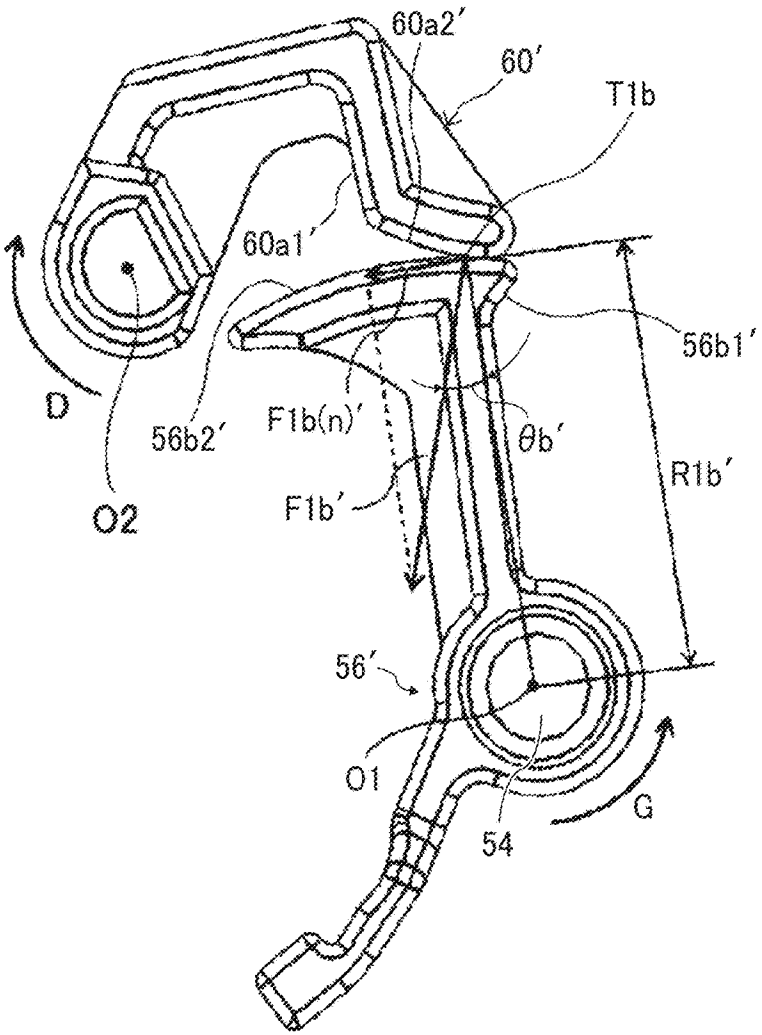
FIGS. 14A to 14D are diagrams illustrating a comparative sheet stopper for explaining a load acting on a contact point while the comparative sheet stopper rotates from the retracted position to the contact position.
Figure 14A:
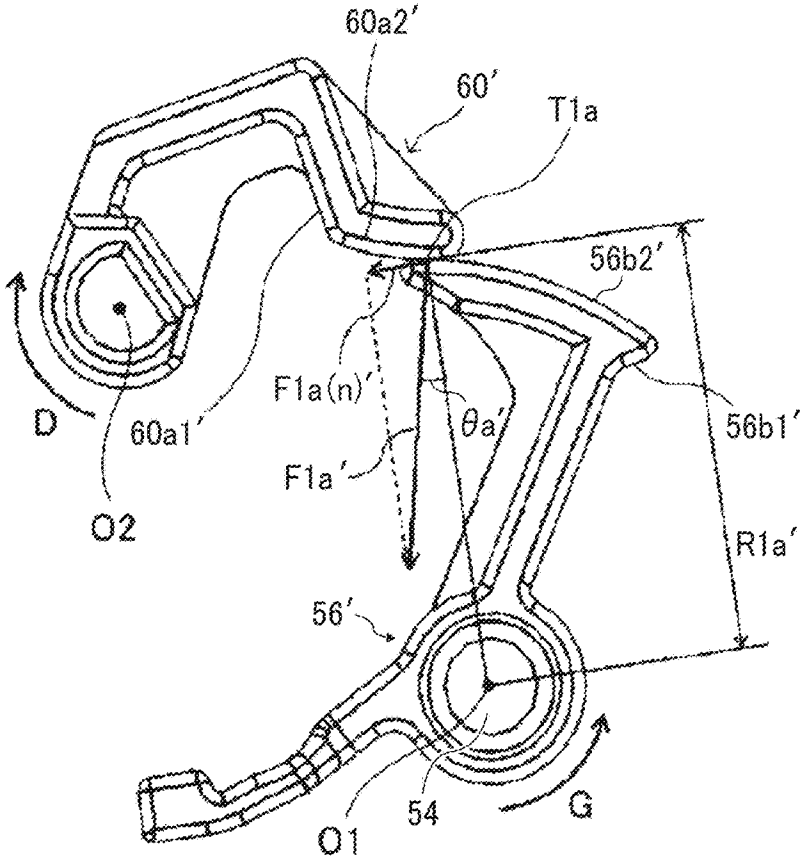

At completion of the sheet feeding operation, as illustrated in FIG. 14A, the sliding projection 60*a*2' of the sheet stopper rotation regulating member 60' contacts near the upstream end in the sliding direction of the sliding target surface 56*b*2' of the sheet stopper 56'. Therefore, the sheet stopper 56' receives a load F1*a*'. Thereafter, as illustrated in FIG. 14B, the sheet stopper 56' rotates about the center of rotation O1 in the counterclockwise direction in FIGS. 14A to 14D while the sliding projection 60*a*2' slides on the sliding target surface 56*b*2' in the sliding direction. In the state illustrated in FIG. 14B, the sheet stopper 56' receives a load F1*b*'. Then, as illustrated in FIG. 14C, as the sliding projection 60*a*2' slides to an area near the downstream end in the sliding direction of the sliding target surface 56*b*2' of the sheet stopper 56', the sheet stopper 56' receives a load F1*c*'.

At this time, respective distances to the center of rotation O1 from a contact point T1*a* at the start of sliding, a contact point T1*b* in the middle of sliding, and a contact point T1*c* at completion of sliding are referred to as distances R1*a*', R1*b*', and R1*c*', respectively. Then, the condition in which the tangential component F1*a*(*n*)' of the load F1*a*' at the contact point T1*a* at the start of sliding rotates the sheet stopper 56' in the direction indicated by arrow G in FIG. 14C (in other words, the direction toward the contact position) is expressed as R1*a*'>R1*b*'. Similarly, the condition in which the tangential component F1*b*(*n*)' of the load F1*b*' at the contact point T1*b* in the middle of sliding rotates the sheet stopper 56' in the direction indicated by arrow G in FIG. 14C is expressed as R1*b*'>R1*c*'. Accordingly, by satisfying the above-described conditions, while the sliding projection 60*a*2' slides from the upstream end to the downstream end of the sliding target surface 56*b*2' of the sheet stopper 56', the rotation force, which causes the sheet stopper 56' to rotate in the direction indicated by arrow G in FIG. 14C, is constantly generated, due to the load F1' acting on the contact point T1.

Figure 14D:
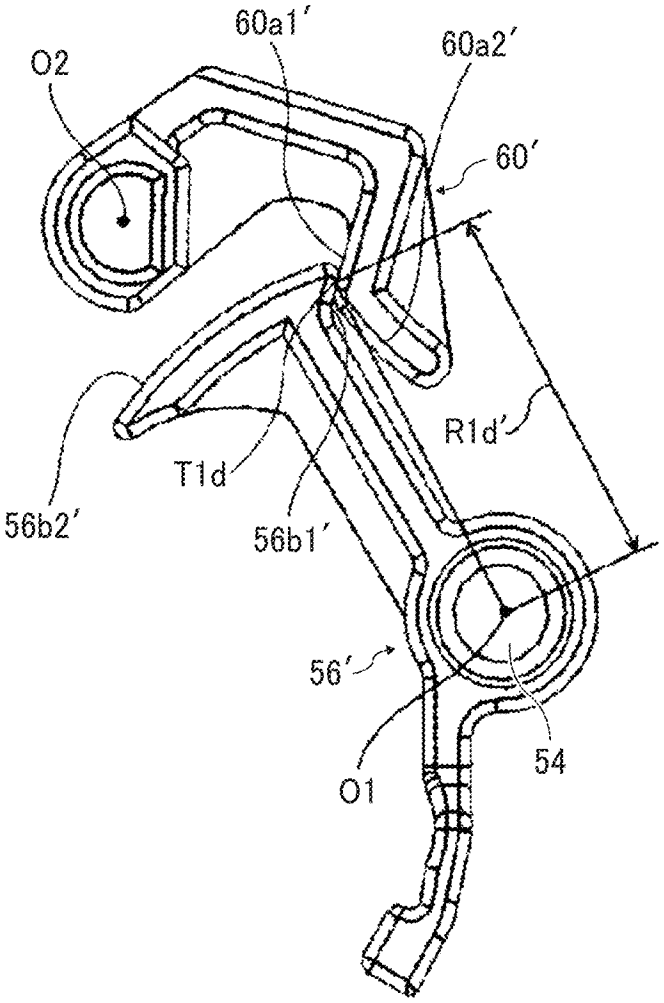
Figure 14C:
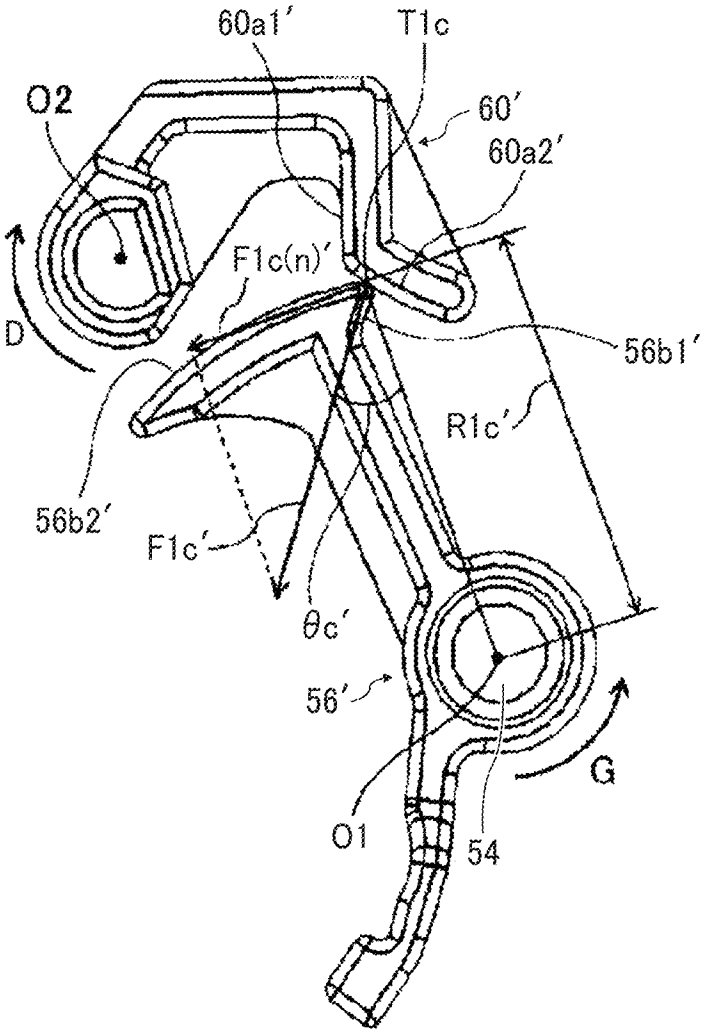

When the sliding projection 60*a*2' extends beyond the downstream end of the sliding target surface 56*b*2' in the sliding direction, the sliding projection 60*a*2' comes off from the sliding target surface 56*b*2', and the sheet stopper rotation regulating member 60' rotates in the direction indicated by arrow D in FIG. 14C due to the biasing force of the regulating member biasing torsion spring. With this operation, as illustrated in FIG. 14D, the locking portion 60*a*1' of the sheet stopper rotation regulating member 60' located upstream from the sliding projection 60*a*2' in the sliding direction is brought to face the locking target portion 56*b*1' of the sheet stopper 56', which functions as a step and is disposed downstream from the downstream end of the sliding target surface 56*b*2' in the sliding direction. This state describes that the sheet stopper 56 has rotated to the contact position and that the sheet stopper 56 that has rotated to the contact position is restricted from rotating to the retracted position.

As illustrated in FIG. 14D, in the state in which the rotation of the sheet stopper 56' is restricted, that is, in the state in which the locking portion 60*a*1' of the sheet stopper rotation regulating member 60' locks the locking target portion 56*b*1' of the sheet stopper 56', a distance from a contact point T1*d* (in other words, the locking position) of the locking portion 60*a*1' and the locking target portion 56*b*1' to the center of rotation O1 is referred to as a distance R1*d*'. At this time, a condition of R1*c*'>R1*d*' is satisfied so that the locking portion 60*a*1' that is located on the upstream side in the sliding direction of the sliding projection 60*a*2' beyond the downstream end in the sliding direction of the sliding target surface 56*b*2' is caught by the locking target portion 56*b*1' located downstream from the sliding target surface 56*b*2' in the sliding direction to be locked properly.

As described above, in the sheet stopper 56'*c* provided in the comparative configuration, the shapes of the sliding target surface 56*b*2' and the locking target portion 56*b*1' of the sheet stopper 56' are supposed to satisfy the condition of R1*a*'>R1*b*'>R1*c*'>R1*d*'.

However, in many cases, it is difficult to increase the contact angle θ' of the sheet stopper 56' due to layout constraints. For example, the sheet stopper rotation regulating member 60' cannot be separated away from the sheet stopper shaft 54 of the sheet stopper 56'. For example, in order to increase the contact angle θ' of the sheet stopper 56', the sliding target surface 56*b*2' of the sheet stopper 56' is supposed to have a large difference between the distance R1*a*' and the distance R1*b*' and a large difference between the distance R1*b*' and the distance R1*c*'. This configuration, however, makes it difficult to satisfy the condition of R1*c*'>R1*d*'. Consequently, it is difficult to lock the locking portion 60*a*1' of the sheet stopper rotation regulating member 60' properly by hooking the locking target portion 56*b*1' to the locking target portion 56*b*1' of the sheet stopper 56'.

Since the contact angle θ' of the sheet stopper 56' does not increase for the above-described reasons, the rotation force of the load F1' (to be more specific, the tangential component F1(*n*)' of the load F1') received from the sheet stopper rotation regulating member 60' does not increase. On the other hand, the normal component F1(*t*)' of the load F1' increases, so that the rotation preventing force of the sliding frictional force F2' and the rotation preventing force of the axial frictional force F4' increase. Therefore, it is likely to easily cause a case in which the sheet stopper 56' cannot rotate to the contact position. In particular, it is likely to increase the number of cases in which the sheet stopper 56' stops without rotating at the contact point T1*a* at the start of sliding, which prevents the sheet stopper 56' from rotating to the contact position.

Figure 15:
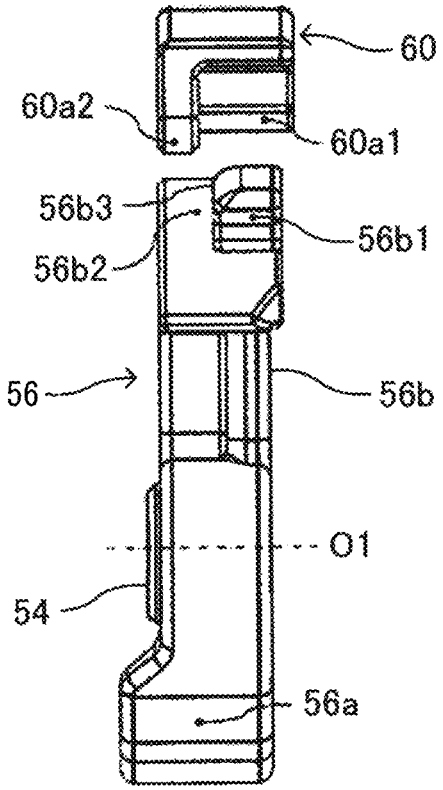
FIG. 15 is a side view illustrating the sheet stopper according to an embodiment of this disclosure, viewed from a direction perpendicular to a rotation center axis of the sheet stopper.

In order to address this inconvenience, as illustrated in FIG. 15, the sheet stopper 56 according to the present embodiment has a configuration in which the locking target portion 56*b*1 and the sliding target surface 56*b*2 of the sheet stopper 56 are disposed at respective positions different from each other along a rotation center axial direction of the sheet stopper 56 (i.e., the left and right directions in FIG. 15). According to this configuration, for example, the locking target portion 56*b*1 of the sheet stopper 56 may be disposed away from the center of rotation O1 of the sheet stopper 56, farther than the sliding target surface 56*b*2 of the sheet stopper 56 (i.e., the relation of Rc<Rd). As a result, even though there are the above-described layout constraints, the shape of the sliding target surface 56*b*2 of the sheet stopper 56 is employed to increase the contact angle θ of the sheet stopper 56, without considering the locking function. In addition, the shape of the locking target portion 56*b*1 of the sheet stopper 56 can be determined such that the locking function is properly performed without considering the contact angle θ of the sheet stopper 56. As a result, while the locking portion 60*a*1 of the sheet stopper rotation regulating member 60 properly locks and releases the locking target portion 56*b*1 of the sheet stopper 56, the contact angle θ of the sheet stopper 56 is increased to restrain occurrence of a case in which the sheet stopper 56 cannot return to the contact position.

FIGS. 16A to 16D are diagrams illustrating the sheet stopper 56 according to an embodiment of this disclosure, for explaining the load F1 acting on the contact point T1 while the sheet stopper 56 rotates from the retracted position to the contact position. It is to be noted that the operations illustrated in FIGS. 16A to 16D correspond to the operations illustrated in FIGS. 14A to 14D, respectively. In addition, it is to be noted that reference symbols F1*a*(*n*), F1*b*(*n*), and F1*c*(*n*) of FIGS. 16A to 16D correspond to reference symbols F1*a*(*n*)', F1*b*(*n*)', and F1*c*(*n*)' of FIGS. 14A to 14D, respectively.

Figure 16B:
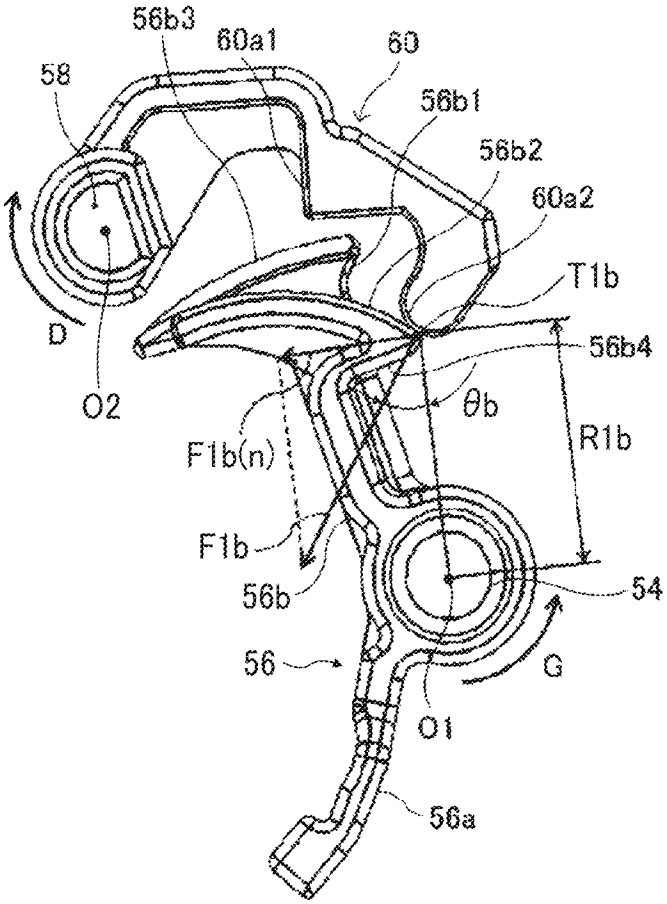
FIGS. 16A to 16D are diagrams illustrating the sheet stopper according to an embodiment of this disclosure, for explaining a load acting on a contact point while the sheet stopper rotates from the retracted position to the contact position.
Figure 16A:
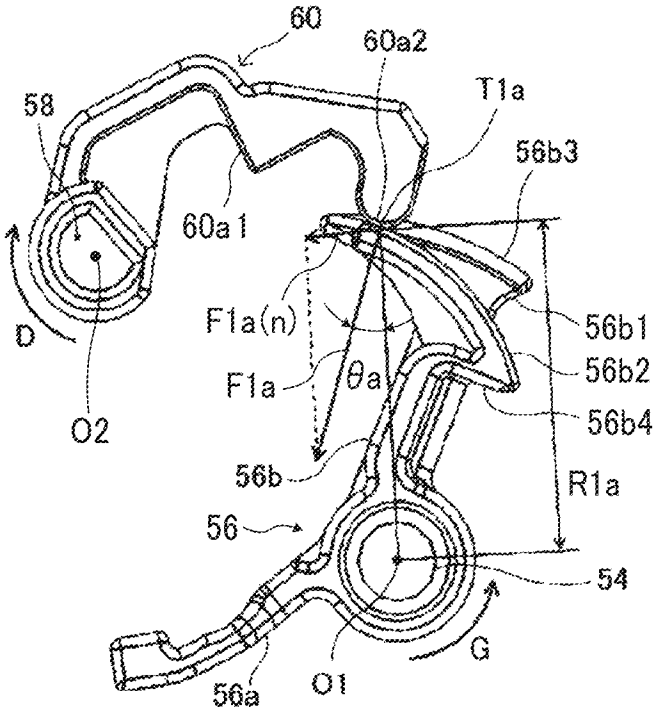
Figure 16D:
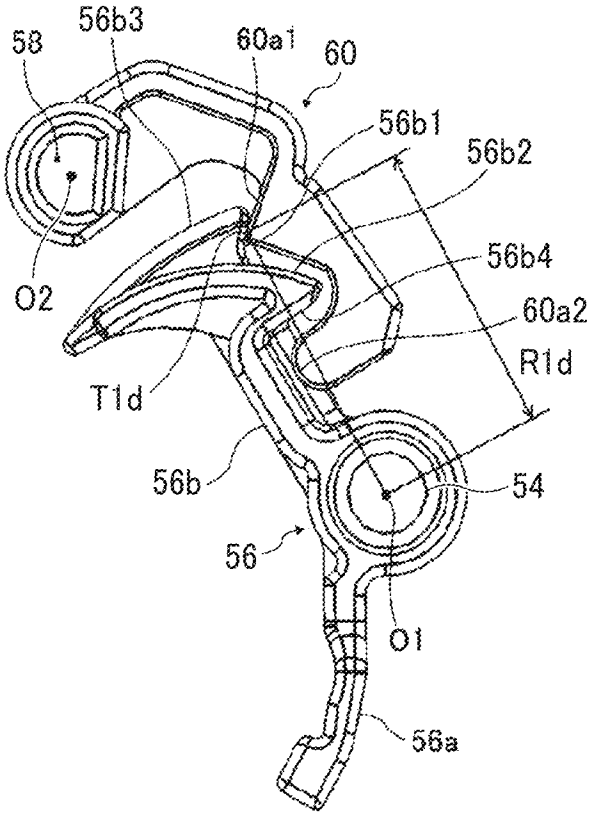
Figure 16C:
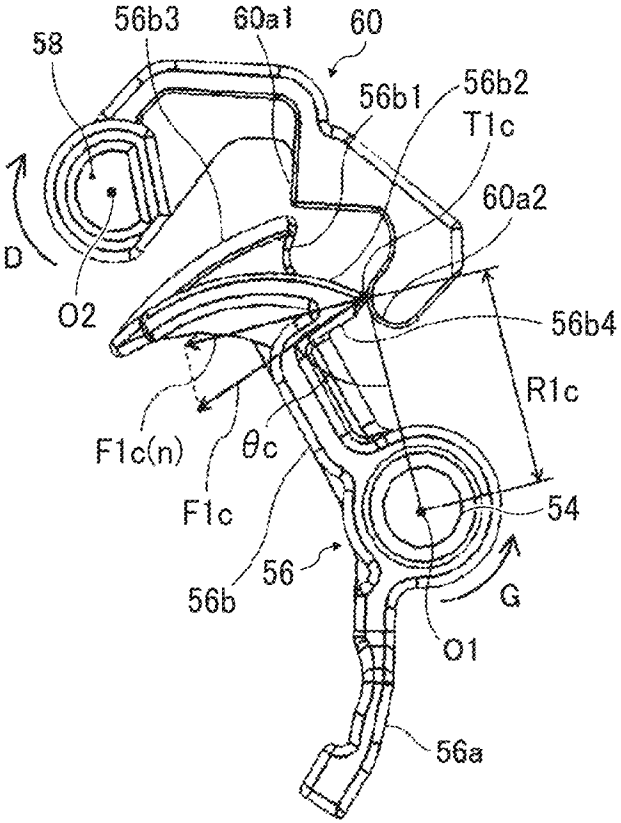

As illustrated in FIGS. 16A to 16C, the sheet stopper 56 according to the present embodiment is configured such that the sliding target surface 56*b*2 of the sheet stopper 56 has a shape that satisfies the condition of R1*a*>R1*b*>R1*c*. Moreover, when compared with the comparative configuration illustrated in FIGS. 14A to 14C, while the relation is expressed as R1*a*≈R1*a*', the sliding target surface 56*b*2 of the sheet stopper 56 has the shape that satisfies the condition of R1*b*<R1*b*' and the condition of R1*c*<R1*c*'. As a result, as illustrated in FIGS. 16A to 16C, respective contact angles θa to θc of the sheet stopper 56 are greater than respective contact angles θa' to θc' of the comparative configuration illustrated in FIGS. 14A to 14C. With this configuration, even at the contact point T1 at the start of sliding when the contact angle is least increased, the contact angle θa, that is a sufficient angle, is obtained. Accordingly, when compared with the comparative configuration, the rotation force of the load F1 (to be more specific, the tangential component F1(*n*) of the load F1) applied by the sheet stopper rotation regulating member 60 increases. On the other hand, the normal component F1(*t*) of the load F1 decreases. Therefore, the rotation preventing force of the sliding frictional force F2 and the rotation preventing force of the axial frictional force F4 decrease. Consequently, the case in which the sheet stopper 56 does not rotate to the contact position is restrained.

When the sliding projection 60*a*2 extends beyond the downstream end of the sliding target surface 56*b*2 in the sliding direction, the sliding projection 60*a*2 comes off from the sliding target surface 56*b*2, and the sheet stopper rotation regulating member 60 rotates in the direction indicated by arrow D in FIG. 16C due to the biasing force of the regulating member biasing torsion spring. With this operation, as illustrated in FIG. 16D, the locking portion 60*a*1 of the sheet stopper rotation regulating member 60 located in the middle of the regulating member arm 60*a* of the sheet stopper rotation regulating member 60 is brought to face the locking target portion 56*b*1 of the sheet stopper 56, which is disposed at the same position as the locking target portion 56*b*1 of the sheet stopper 56 in the axial center direction. This state describes that the sheet stopper 56 has rotated to the contact position and that the sheet stopper 56 that has rotated to the contact position is restricted from rotating to the retracted position.

At this time, when compared with the comparative configuration illustrated in FIG. 14D, the sheet stopper 56 according to the present embodiment satisfies the condition of R1*d*≈R1*d*', the function of locking and releasing the locking portion 60*a*1 of the sheet stopper rotation regulating member 60 with respect to the locking target portion 56*b*1 of the sheet stopper 56 is retained to be equal to the function of locking and releasing the comparative configuration.

Therefore, according to the present embodiment, while the locking portion 60*a*1 of the sheet stopper rotation regulating member 60 properly locks and releases the locking target portion 56*b*1 of the sheet stopper 56, the contact angle θ of the sheet stopper 56 is increased to restrain occurrence of the case in which the sheet stopper 56 cannot return to the contact position.

Figure 17B:
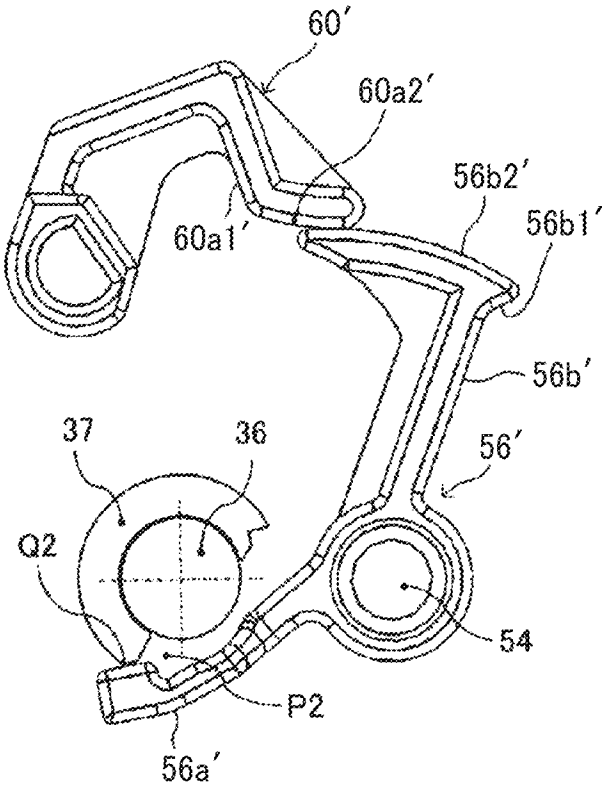
FIGS. 17A and 17B are schematic views illustrating an example of limitations of layout constraints, in an embodiment of this disclosure.
Figure 17A:
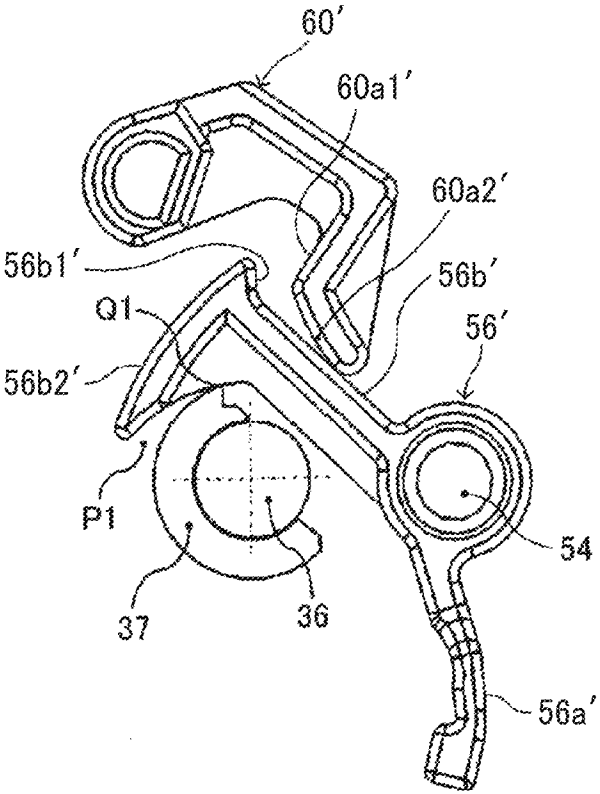

FIGS. 17A and 17B are schematic views illustrating an example of limitations of layout constraints, in an embodiment of this disclosure.

As illustrated in FIGS. 17A and 17B, the sheet feed roller shaft 36 and the rotary shaft bearing 37 are provided near the sheet stopper 56'. Therefore, the sheet stopper 56' rotates in the counterclockwise direction in FIGS. 17A and 17B, to a position where the second stopper arm 56*b*' of the sheet stopper 56' contacts the sheet feed roller shaft 36 and the rotary shaft bearing 37 at the contact position Q1, as illustrated in FIG. 17A. Further, the sheet stopper 56' rotates in the clockwise direction in FIGS. 17A and 17B, to a position where the first stopper arm 56*a*' of the sheet stopper 56' contacts the sheet feed roller shaft 36 and the rotary shaft bearing 37 at the contact position Q2, as illustrated in FIG. 17B.

Under such layout constraints, since the rotatable range of the sheet stopper 56' is narrow, it is difficult to change the shape of the sheet stopper 56' such that, for example, the rotation force F3(*n*)' acting on the gravity center position T2 is increased by increasing the gravity F3' acting on the gravity center position T2 of the sheet stopper 56' or by increasing the distance from the center of rotation O1 of the sheet stopper 56' to the gravity center position T2. It is difficult to change the shape of the sheet stopper 56' because respective clearances P1 and P2 between the sheet stopper 56' and the sheet feed roller shaft 36 and the rotary shaft bearing 37 are significantly small under the above-described layout constraints.

It is to be noted that, in this embodiment, as illustrated in FIGS. 16A to 16C, while the sliding projection 60*a*2 of the sheet stopper rotation regulating member 60 is in contact with the sliding target surface 56*b*2 of the sheet stopper 56, the sheet stopper rotation regulating member 60 and the sheet stopper 56 do not contact with each other at any contact points other than the contact point at which the sliding projection 60*a*2 and the sliding target surface 56*b*2 contact with each other. Therefore, while the sheet stopper 56' rotates toward the contact position, no sliding occurs between the sheet stopper rotation regulating member 60 and the sheet stopper 56 at any points other than the contact point of the sliding projection 60*a*2 and the sliding target surface 56*b*2 (for example, at any points between the locking portion 60*a*1 of the sheet stopper rotation regulating member 60 and the opposed face (i.e., a guide 56*b*3) of the sheet stopper 56 disposed facing the locking portion 60*a*1 of the sheet stopper rotation regulating member 60), the rotation preventing force is reduced, and occurrence of the case in which the sheet stopper 56 cannot return to the contact position is further restrained.

Further, in the present embodiment, as illustrated in FIG. 16D, while the locking portion 60*a*1 of the sheet stopper rotation regulating member 60 locks the locking target portion 56*b*1 of the sheet stopper 56, the sheet stopper rotation regulating member 60 and the sheet stopper 56 do not contact with each other at any points other than a locking point of the locking portion 60*a*1 and the locking target portion 56*b*1 (for example, at any points between the sliding projection 60*a*2 of the sheet stopper rotation regulating member 60 and the step 56*b*4 of the sheet stopper 56 disposed facing the sliding projection 60*a*2 of the sheet stopper rotation regulating member 60). According to this configuration, the locking state of the locking portion 60*a*1 and the locking target portion 56*b*1 remains stable, thereby avoiding a case in which the locking state is unintentionally cancelled.

Further, in the present embodiment, it is likely that a relative positional deviation in the rotation center axial direction occurs between the sheet stopper 56 and the sheet stopper rotation regulating member 60 with backlash due to poor assembly. In this case, the sliding projection 60*a*2 of the sheet stopper rotation regulating member 60 comes off from the sliding target surface 56*b*2 of the sheet stopper 56 in the rotation center axial direction, and therefore it is likely that the sliding projection 60*a*2 of the sheet stopper rotation regulating member 60 contacts the sheet stopper 56. For this reason, in the present embodiment, a positional deviation correcting unit is provided to correct a relative positional deviation between the sheet stopper 56 and the sheet stopper rotation regulating member 60 in the rotation center axial direction.

The positional deviation correcting unit according to the present embodiment includes the guide 56*b*3 that is inclined toward the sliding target surface 56*b*2 of the sheet stopper 56, at the same position as the locking target portion 56*b*1 of the sheet stopper 56 in the rotation center axial direction. There may be a case in which e sliding projection 60*a*2 of the sheet stopper rotation regulating member 60 comes off from the sliding target surface 56*b*2 of the sheet stopper 56 toward the rotation center axial direction due to the relative positional deviation in the rotation center axial direction between the sheet stopper 56 and the sheet stopper rotation regulating member 60, and therefore the sliding projection 60*a*2 of the sheet stopper rotation regulating member 60 contacts the guide 56*b*3 of the sheet stopper 56. According to the above-described configuration, when this case occurs, the sliding projection 60*a*2, which is biased by the biasing force of the regulating member biasing torsion spring, slides on the sloped face of the guide 56*b*3 to be guided to the sliding target surface 56*b*2 of the sheet stopper 56. As a result, the relative positional deviation between the sheet stopper 56 and the sheet stopper rotation regulating member 60 is corrected.

It is to be noted that the sheet feeding device 30 according to the present embodiment does not include a biasing member to bias the sheet stopper 56 to return to the contact position. In this configuration, the above-described balanced state is easily generated when compared with a configuration including such a biasing member. However, by employing the sheet stopper 56 according to the present embodiment, even though the sheet feeding device 30 does not include the above-described biasing member and generates the above-described balanced state easily, the inconvenience that the sheet stopper 56 cannot return to the contact position is restrained. Therefore, when the sheet S is set on the bypass sheet feed tray 104, the sheet stopper 56 is located at the contact position, so that the sheet stopper rotation regulating member 60 restricts movement of the sheet stopper 56.

Further, a configuration to rotate the sheet stopper rotation regulating member 60 in the direction indicated by arrow D in FIG. 5 is not limited to the configuration including the regulating member biasing torsion spring, but a configuration in which the sheet stopper rotation regulating member 60 rotates by the own weight is also applicable.

An image forming apparatus including the sheet feeding device (i.e., the sheet feeding device 30) according to this disclosure is not limited to a copier. For example, the sheet feeding device according to this disclosure is applicable to an image forming apparatus including the functions of a printing apparatus, an inkjet recording apparatus, a printer, a copier, and a facsimile machine. Further, an image forming apparatus including the sheet feeding device according to this disclosure is not limited to the image forming apparatus 100. For example, an image forming apparatus including the sheet feeding device according to this disclosure may be an inkjet-type image forming apparatus.

Further, a sheet that is conveyed by the sheet feeding device according to the present disclosure is not limited to a recording medium such as the sheet S. Further, a sheet feeding device is not limited to a sheet feeding device such as a bypass sheet feeding device employed in an image forming apparatus. For example, a sheet feeding device may be used an apparatus other than an image forming apparatus as long as the apparatus feeds and conveys a plurality of accumulated sheets.

An automatic document feeder such as the ADF 200 illustrated in FIG. 2 may be an apparatus that feeds and conveys the plurality of accumulated sheets. The ADF 200 illustrated in FIG. 2 feeds a sheet placed on top of a sheet bundle loaded on an original document table 201, conveys the sheet to pass a reading position where image data on the sheet is read by the scanner 300, and ejects the sheet to a document ejection tray 202. As a document feeding unit to feed an original document placed on the original document table 201 in the ADF 200, the sheet feeding device according to this disclosure that includes the same configuration as the above-described sheet feeding device 30 is applied.

A sheet to be fed by the sheet feeding device according to this disclosure includes not only a sheet-like member but also a thin plate-like member. Further, the term "sheet" includes a paper, a cloth, a resin sheet, a protective paper on the front and back faces, a metal sheet, an electronic circuit board material subject to metal foil plating such as a copper foil or electroplating, a special film, a plastic film, a prepreg, an electronic circuit substrate sheet, and the like. The prepreg is a sheet-like material in which carbon fiber or the like is previously impregnated with resin. As an example, the prepreg includes a sheet-like reinforced plastic molding material that is manufactured by, for example, impregnating a thermosetting resin, into which additives such as curative agent and coloring agent are mixed, in a fibrous reinforcing material such as a carbon fiber or a glass cloth, and then heating or drying to a semi-cured state.

The configurations according to the above-descried embodiments are not limited thereto. This disclosure can achieve the following aspects effectively.

Aspect 1.

In Aspect 1, a sheet feeding device (for example, the sheet feeding device 30) includes a contact member (for example, the sheet stopper 56) and a lock member (for example, the sheet stopper rotation regulating member 60). The contact member includes a contact body (for example, the first stopper arm 56*a*) configured to contact a leading end of a sheet (for example, the sheet S) in a sheet conveyance direction, and a lock target body (for example, the locking target portion 56*b*1). The contact member is configured to rotate between a contact position at which the contact body contacts the sheet and a retracted position at which the contact body is spaced apart from the sheet. The lock member includes lock member (for example, the sheet stopper rotation regulating member 60) including a lock body (for example, the locking portion 60*a*1) configured to lock the lock target body of the contact member to restrict rotation of the contact member from the contact position to the retracted position. The lock member is configured to rotate between a locked position at which the lock body locks the lock target body and a lock released position at which the lock body releases the lock target body. The lock member is configured to receive a lock biasing force applied due to a weight of the lock member or by a biasing member (for example, the regulating member biasing torsion spring) when the lock member moves in a lock direction (for example, the lock direction D) of the lock member from the lock released position toward the locked position. The contact member is configured to rotate from the retracted position to the contact position while a sliding portion (for example, the sliding projection 60*a*2) of the lock member and a sliding target portion (for example, the sliding target surface 56*b*2) of the contact member are sliding. The contact member is configured to rotate to the contact position to release the sliding portion of the lock member from the sliding target portion of the contact member. The lock member is configured to rotate to the locked position by the lock biasing force. The contact member is disposed the lock target body and the sliding target portion at different positions from each other in a rotation center axial direction of the contact member.

At the end of feeding, since the sliding portion of the lock member and the sliding target portion of the contact member are in contact with each other by the lock biasing force of the lock member, the sliding portion of the lock member slides on the sliding target portion of the contact member while the contact member rotates from the retracted position to the contact position. As the contact member rotates and reaches the contact position against the sliding resistance, the sliding portion comes off from the sliding target portion, so that the lock member becomes rotatable toward the locking position. Accordingly, the lock member rotates to the locking position due to the biasing force. Consequently, the lock target body of the contact member is locked by the locking portion of the lock member, and therefore the contact member located at the contact position is restricted from rotating toward the retracted position. As a result, the contact portion of the contact member prevents the leading end of a new sheet to be set from entering the downstream side in the sheet conveyance direction, further than a target set position.

In the comparative configuration, there was a case in which the contact member does not return to the contact position at completion of sheet feeding. This inconvenience was caused due to the balanced state in which a rotation preventing force that prevents the contact member from rotating from the retracted position to the contact position (for example, a frictional force of the sliding portion of the lock member and the sliding target portion of the contact member) and a rotation force that rotates the contact member from the retracted position to the contact position are balanced. In order to prevent this balanced state, the rotation force is set to be sufficiently large to the rotation preventing force.

However, if the rotational force by which the contact member rotates from the retracted position to the contact position is increased, the leading end of a sheet such as a thin paper cannot push away the contact portion of the contact member with the rotational force, and therefore it is likely that a sheet feeding failure occurs. If a drive mechanism to cause the contact member to rotate from the contact position to the retracted position to prevent this inconvenience, the configuration becomes complicated, which results in a cost increase. Accordingly, it is considered that there is a limit in increasing the rotational force of the contact member to rotate from the retracted position to the contact position. Therefore, in order to prevent the balanced state from occurring, the rotation preventing force to prevent the contact member from the retracted position to the contact position is reduced.

Here, if the frictional force between the sliding portion of the lock member and the sliding target portion of the contact member is reduced, the rotation preventing force is also reduced. In order to reduce the frictional force, it is demanded to increase the contact angle of the sliding portion of the lock member to the sliding target portion of the contact member, in other words, the angle of the normal direction of the sliding target portion at the contact point and the contact direction of the sliding portion to the sliding target portion. As the contact angle increases, the vertical direction component of the contact portion that increases the frictional force in the lock biasing force of the lock member is reduced, and therefore the rotation preventing force is reduced.

However, in the comparative configuration, the sliding portion and the locking portion of the lock member are provided by a common member. After the sliding portion (i.e., the locking portion) of the lock member slides the sliding target portion of the contact member to the downstream end in the sliding direction, the sliding portion (i.e., the locking portion) is pushed down to a step portion (for example, the lock target portion) provided at the downstream end due to the lock biasing force, so that the contact member is locked. In such a configuration, the locking portion of the contact member and the sliding portion of the lock member are arranged at the same position in the rotation center axial direction of the contact member. There are great restrictions on the configuration such that the member must be located closer to the center of rotation of the contact member than the sliding portion of the lock member. As a result, it has been difficult to restrain occurrence of the above-described balanced state by increasing the contact angle of the sliding portion of the lock member to the sliding target portion of the contact member while the locking portion of the lock member locks and releases the locking target portion of the contact member properly.

Therefore, in Aspect 1, the locking target portion of the contact member and the sliding target portion are disposed at different positions from each other, in the rotation center axial direction of the contact member. Accordingly, this configuration can reduce the limitation, for example, that the locking target portion of the contact member is located at a position close to the center of rotation of the contact member, is reduced. As a result, while the sliding target portion of the contact member and the sliding portion of the lock member are configured such that the contact angle of the sliding portion of lock member to the sliding target portion of the contact member is increased, the locking target portion of the contact member and the locking portion of the lock member can be configured such that the locking portion of the lock member properly locks and releases the locking target portion of the contact member. As a result, while the locking portion of the lock member locks and releases the locking target portion of the contact member properly, this configuration can prevent occurrence of the above-described balanced state, and therefore prevents the inconvenience that the sheet stopper does not return to the contact position.

Aspect 2.

In Aspect 2, the sliding target portion (for example, the sliding target surface 56*b*2) of the contact member (for example, the sheet stopper 56) is disposed farther away from the rotation center axial direction of the contact member, than the lock target body (for example, the locking target portion 56*b*1) of the contact member is.

According to this configuration, a simple configuration may be provided to restrain occurrence of the above-described balanced state while the locking portion of the lock member locks and releases the locking target portion of the contact member properly, and therefore prevents occurrence of a case in which the contact member does not return to the contact position at completion of the sheet feeding operation.

Aspect 3.

In Aspect 3, the contact member (for example, the sheet stopper 56) is configured to receive a contact biasing force applied due to a weight of the contact member or by a biasing member (for example, the regulating member biasing torsion spring) when the contact member moves in a contact direction of the contact member from the retracted position toward the contact position.

According to this configuration, since the rotational force to rotate the contact member from the retracted position to the contact position is increased by the contact biasing force, it is easy to provide a configuration to restrain occurrence of the above-described balanced state while the locking portion of the lock member locks and releases the locking target portion of the contact member properly, and therefore prevents occurrence of a case in which the contact member does not return to the contact position at completion of the sheet feeding operation.

Aspect 4.

In Aspect 4, when the sliding portion (for example, the sliding projection 60*a*2) of the lock member (for example, the sheet stopper rotation regulating member 60) and the sliding target portion (for example, the sliding target surface 56*b*2) of the contact member (for example, the sheet stopper 56) contact each other at a contact portion, the lock member and the contact member contact each other at the contact portion alone.

According to this configuration, while the contact member rotates toward the contact position, no sliding occurs between the contact member and the lock member at any points other than the contact point of the sliding portion and the sliding target portion. Therefore, the rotation preventing force is reduced, and occurrence of the case in which the contact member cannot return to the contact position is further restrained.

Aspect 5.

In Aspect 5, while the lock body (for example, the locking portion 60*a*1) of the lock member (for example, the sheet stopper rotation regulating member 60) and the lock target body (for example, the locking target portion 56*b*1) of the contact member (for example, the sheet stopper 56) are locked each other at a lock portion, the lock member and the contact member contact each other at the contact portion alone.

According to this configuration, the locking state of the locking portion and the locking target portion remains stable, thereby avoiding a case in which the locking state is unintentionally cancelled.

Aspect 6.

In Aspect 6, the sheet feeding device (for example, the sheet feeding device 30) further includes a position corrector (for example, the guide 56*b*3) configured to correct a relative positional deviation generated between the contact member (for example, the sheet stopper 56) and the lock member (for example, the sheet stopper rotation regulating member 60) in the rotation center axial direction of the contact member.

According to this configuration, even if the relative positional deviation in the rotation center axial direction occurs between the contact member and the lock member, the relative positional deviation is corrected by the position corrector. Therefore, the sliding portion properly on the sliding target portion and the locking portion locks the locking target portion properly.

Aspect 7.

In Aspect 7, the position corrector includes a guide (for example, the guide 56*b*3) disposed on the contact member (for example, the sheet stopper 56) at a same position as a lock target body (for example, the locking target portion 56*b*1), in the rotation center axial direction. The guide is configured to cause the sliding portion (for example, the sliding projection 60*a*2) to slide toward the sliding target portion (for example, the sliding target surface 56*b*2) when the sliding portion of the lock member (for example, the sheet stopper rotation regulating member 60) contacts the guide.

According to this configuration, a relative positional deviation in the rotation center axial direction between the contact member and the lock member can be corrected with a simple configuration.

Aspect 8.

In Aspect 8, the sheet feeding device (for example, the sheet feeding device 30) further includes a lock member drive unit (the solenoid 62) configured to rotate the lock member (for example, the sheet stopper rotation regulating member 60) against the lock biasing force from the locked position to the lock released position.

According to this configuration, the lock member drive unit controls the lock member to rotate between the locking position and the locking release position.

Aspect 9.

In Aspect 9, the sheet feeding device (for example, the sheet feeding device 30) further includes a sheet feed member (for example, the sheet pickup roller 40) configured to contact and separate with respect to the sheet (for example, the sheet S) loaded on a sheet loader (for example, the bypass sheet feed tray 104) to feed the sheet. The sheet feed member is configured to contact and separate with respect to the sheet on the sheet loader, along with movement of the lock member drive unit (for example, the solenoid 62).

According to this configuration, when compared with the configuration in which the drive unit to contact and separate the sheet feed member is provided separately, the sheet feeding device can be simpler with a lower cost.

Aspect 10.

In Aspect 10, the lock member drive unit (for example, the solenoid 62) includes a straight core member (for example, the movable iron core 68) configured to be driven to perform a linear motion. The lock member drive unit rotates the lock member (for example, the sheet stopper rotation regulating member 60), along with the linear motion of the straight core member, from the locked position to the lock release position.

According to this configuration, a configuration in which the lock member is rotated by a linear motion of the lock member drive unit.

Aspect 11.

In Aspect 11, an image forming apparatus (for example, the image forming apparatus 100) includes the sheet feeding device (for example, the sheet feeding device 30) according to Aspect 1, configured to feed a sheet (for example, the sheet S), and an image forming device (for example, the image forming unit 110) configured to form an image on the sheet fed from the sheet feeding device.

According to this configuration, occurrence of the above-described balanced state is restrained while the locking portion of the lock member locks and releases the locking target portion of the contact member properly, and therefore prevents a case in which the contact member does not return to the contact position at completion of the sheet feeding operation. Accordingly, this configuration can prevent occurrence of multiple feeding failure or skew due to the sheet entering the downstream side in the sheet conveyance direction, further downstream than the position at which the sheet that is set at the sheet setting contacts the contacting portion of the contact member. Consequently, a stable sheet feeding operation can be performed, and therefore a stable image forming operation can be performed.

Aspect 12.

In Aspect 12, the sheet feeding device (for example, the sheet feeding device 30) is a bypass sheet feeder (for example, the bypass sheet feeding device 105) including a bypass tray (for example, the bypass sheet feed tray 104). The bypass sheet feeder is configured to feed the sheet (for example, the sheet S) loaded on the bypass tray.

In the bypass tray, it is prevented from a failure in which the sheet is likely to enter the downstream side in the sheet conveyance direction, further from a position where the sheet is placed when setting the sheet on the bypass tray.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure, and are included in the scope of the invention recited in the claims and its equivalent.

Any one of the above-described operations may be performed in various other ways, for example, in an order different from the one described above.

What is claimed is:

1. A sheet feeding device comprising:

a contact member including a contact body configured to contact a leading end of a sheet in a sheet conveyance direction; and a lock target body, the contact member being configured to rotate between a contact position at which the contact body is in contact with the sheet and a retracted position at which the contact body is spaced apart from the sheet; and a lock member including a lock body configured to lock the lock target body of the contact member to restrict rotation of the contact member from the contact position to the retracted position, the lock member being configured to rotate between a locked position at which the lock body locks the lock target body and a lock released position at which the lock body releases the lock target body, the lock member configured to receive a lock biasing force applied due to a weight of the lock member or by a biasing member when the lock member moves in a lock direction of the lock member from the lock released position toward the locked position, the contact member being configured to rotate from the retracted position to the contact position while a sliding portion of the lock member is sliding on a sliding target portion of the contact member, the contact member being configured to rotate to the contact position to release the sliding portion of the lock member from the sliding target portion of the contact member, the lock member being configured to rotate to the locked position by the lock biasing force, the contact member having the lock target body and the sliding target portion at different positions from each other in a rotation center axial direction of the contact member.

2. The sheet feeding device according to claim 1, wherein the lock target body of the contact member is disposed farther away from a center of rotation of the contact member, than the sliding target portion of the contact member is.

3. The sheet feeding device according to claim 1, wherein the contact member is configured to receive a contact biasing force applied due to a weight of the contact member or by a biasing member when the contact member moves in a contact direction of the contact member from the retracted position toward the contact position.

4. The sheet feeding device according to claim 1, wherein, when the sliding portion of the lock member contacts the sliding target portion of the contact member at a contact portion, the lock member contacts the contact member at the contact portion alone.

5. The sheet feeding device according to claim 1, wherein, while the lock body of the lock member locks the lock target body of the contact member at a locking point, the lock member contacts the contact member at the locking point alone.

6. The sheet feeding device according to claim 1, further comprising a position corrector configured to correct a relative positional deviation generated between the contact member and the lock member in the rotation center axial direction of the contact member.

7. The sheet feeding device according to claim 6, wherein the position corrector includes a guide disposed on the contact member at a same position as the lock target body in the rotation center axial direction, and wherein the guide is configured to cause the sliding portion to slide toward the sliding target portion when the sliding portion of the lock member contacts the guide.

8. The sheet feeding device according to claim 1, further comprising a lock member drive unit configured to rotate the lock member against the lock biasing force from the locked position to the lock released position.

9. The sheet feeding device according to claim 8, further comprising a sheet feed member configured to contact and separate with respect to the sheet loaded on a sheet loader to feed the sheet, wherein the sheet feed member is configured to contact and separate with respect to the sheet on the sheet loader, along with movement of the lock member drive unit.

10. The sheet feeding device according to claim 9, wherein the lock member drive unit includes a straight core member configured to be driven to perform a linear motion, and wherein the lock member drive unit rotates the lock member, along with the linear motion of the straight core member, from the locked position to the lock release position.

11. An image forming apparatus comprising:

the sheet feeding device according to claim 1, configured to feed a sheet; and an image forming device configured to form an image on the sheet fed from the sheet feeding device.

12. The image forming apparatus according to claim 11, wherein the sheet feeding device is a bypass sheet feeder including a bypass tray; and wherein the bypass sheet feeder is configured to feed the sheet loaded on the bypass tray.

* * * * *